US006425169B1

(12) United States Patent
Briscoe

(10) Patent No.: US 6,425,169 B1
(45) Date of Patent: Jul. 30, 2002

(54) SURFACE WORKING APPARATUS

(76) Inventor: William Anthony Briscoe, Wades House, Winchester, Hampshire (GB)

( * ) Notice: Subject to any disclaimer, the term of this patent is extended or adjusted under 35 U.S.C. 154(b) by 0 days.

(21) Appl. No.: 09/046,727

(22) Filed: Mar. 24, 1998

(30) Foreign Application Priority Data

Mar. 24, 1997 (GB) ..... 9706074
Dec. 9, 1997 (GB) ..... 9726030

(51) Int. Cl.[7] ..... A47L 11/16; E01H 1/05; B24B 39/00

(52) U.S. Cl. ..... 29/90.01; 451/359; 15/52; 15/87; 15/98; 403/138

(58) Field of Search ..... 29/90.01; 451/353, 451/359; 15/49.1, 52, 87, 98; 403/59, 61, 125, 138, 144, 66

(56) References Cited

U.S. PATENT DOCUMENTS

| | | | | | |
|---|---|---|---|---|---|
| 1,000,696 | A | * | 8/1911 | Schlueter | 451/353 |
| 1,067,889 | A | * | 7/1913 | Trudeau | 15/49.1 |
| 2,136,324 | A | * | 11/1938 | Simon | 15/52 |
| 3,102,744 | A | * | 9/1963 | Reuter et al. | |
| 3,197,798 | A | * | 8/1965 | Brown et al. | 15/87 |
| 3,897,703 | A | * | 8/1975 | Phipps | |
| 3,946,692 | A | * | 3/1976 | Sierra et al. | 15/49.1 |
| 4,317,314 | A | * | 3/1982 | Carlstrom et al. | 451/353 |
| 4,319,434 | A | | 3/1982 | Brejcha | |
| 4,910,824 | A | * | 3/1990 | Nagayama | |
| 5,243,727 | A | * | 9/1993 | Tanaka et al. | 451/353 |
| 5,421,053 | A | * | 6/1995 | Chodak | 15/49.1 |
| 5,513,409 | A | * | 5/1996 | Biegel | 15/49.1 |
| 5,673,450 | A | * | 10/1997 | Briscoe | 15/49.1 |

FOREIGN PATENT DOCUMENTS

| | | | | |
|---|---|---|---|---|
| CH | 219 092 | | 5/1942 | |
| DE | 450 298 | | 10/1927 | |
| GB | 467 200 | | 6/1937 | |
| GB | 2 042 331 | | 9/1980 | |
| IT | 479007 | * | 4/1954 | 451/353 |
| IT | 501105 | * | 9/1956 | 451/359 |
| JP | 162494 | * | 9/1984 | 15/49.1 |
| JP | 08280592 | * | 10/1996 | |
| WO | 91/04701 | * | 4/1991 | 15/49.1 |

* cited by examiner

*Primary Examiner*—S. Thomas Hughes
*Assistant Examiner*—Eric Compton
(74) *Attorney, Agent, or Firm*—Young & Thompson

(57) ABSTRACT

A surface working apparatus includes a surface working head arrangement having a frame member and a plurality of surface working members arranged to depend therefrom in the direction of the surface to be worked, each of the plurality of surface working members being mounted resiliently relative to the frame member by one of a plurality of respective resilient mounting arrangements having a resilient member; and a surface working device with a support plate from which a surface working element is to depend from a lower surface thereof, the support plate includes an upper surface which has a central region with a recess provided for the receipt of a drive member for rotating the device, the recess including a formation for receiving a resilient member for engagement by the drive member.

30 Claims, 25 Drawing Sheets

FIG. 6A
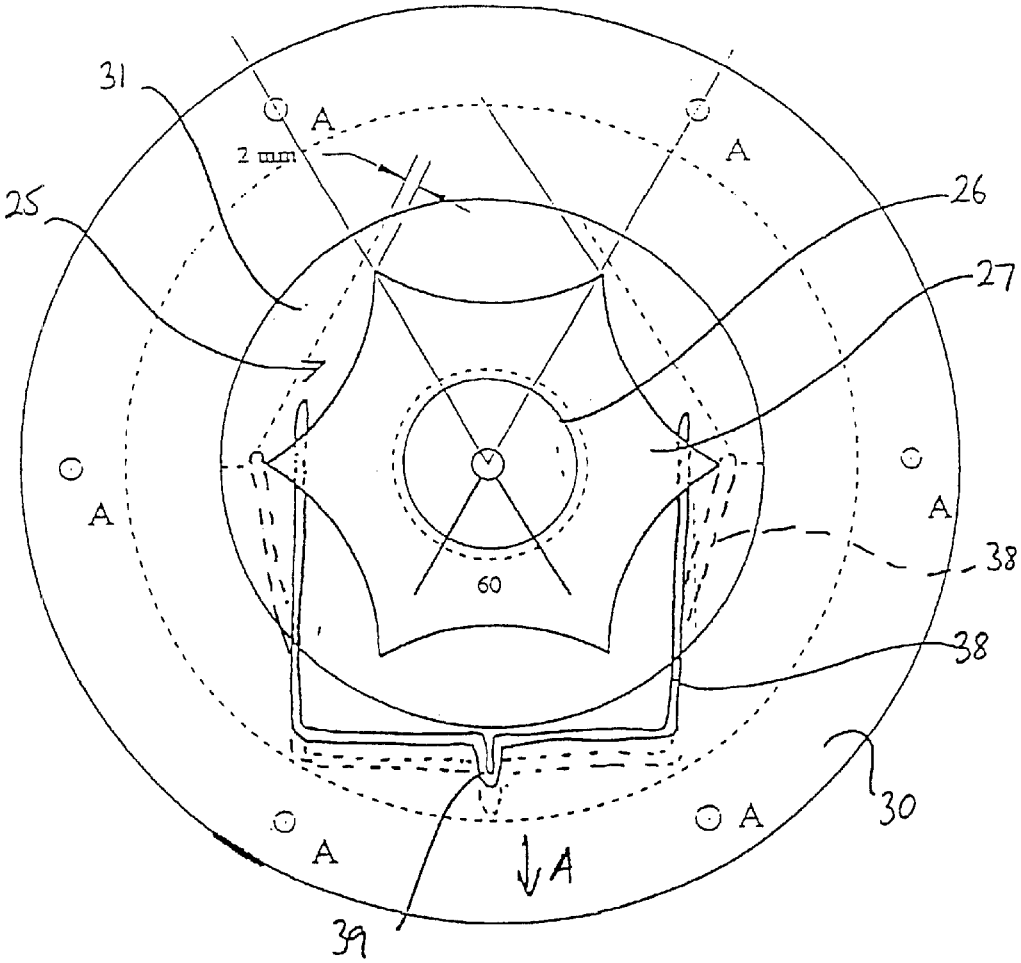
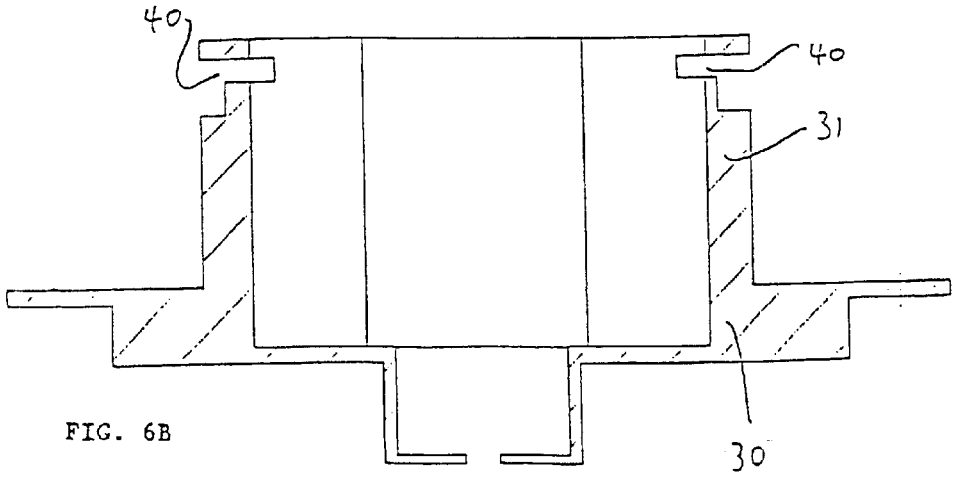
FIG. 6B

Connect with Fig. 10B ⟶

Connect with Fig. 10D
U8B
5
6
7
D17
R22
R35
R29
R31
C18
C14
R27
C11
C13
R24
D16
R6
R23
RL2
BRUSH
D4
Q5
RL4
DOWN
D6
RL3
UP
D5
P5
Connect with Fig. 10C FIG. 12
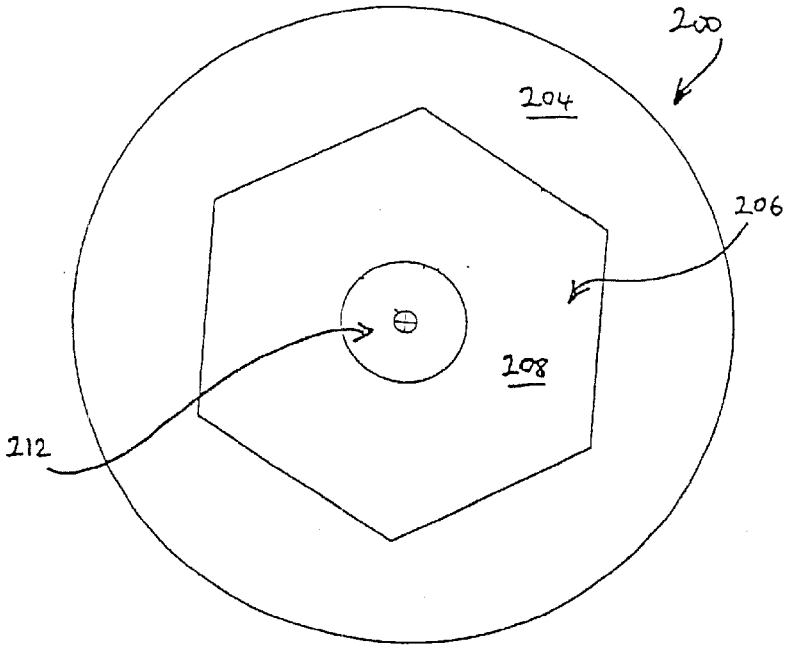
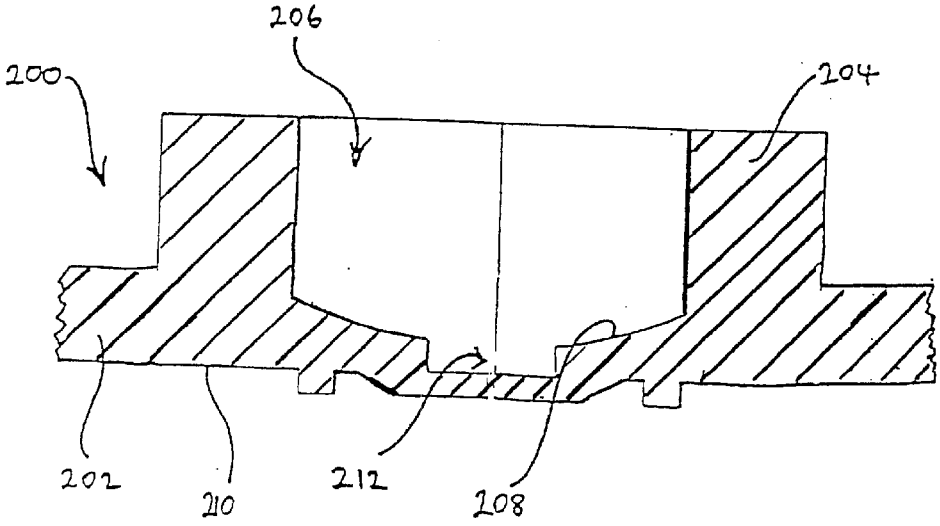
FIG. 13

FIG. 15
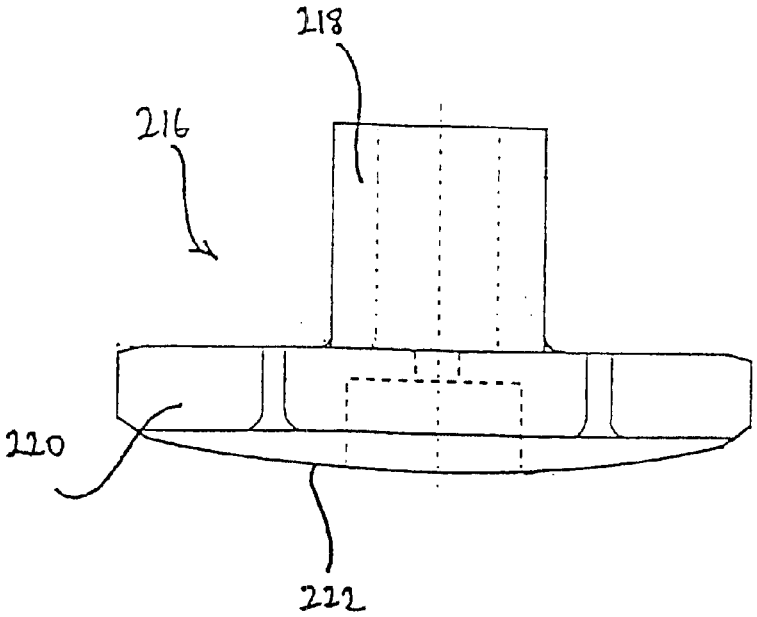
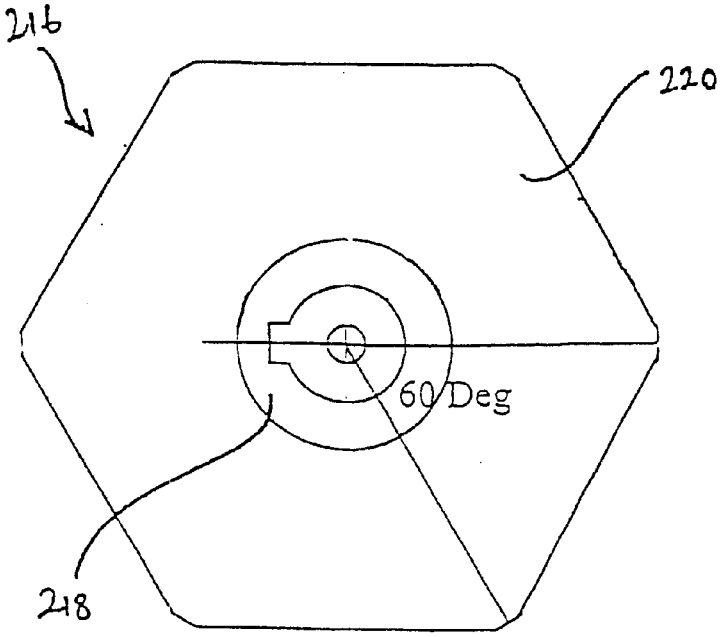
FIG. 16

SURFACE WORKING APPARATUS

BACKGROUND OF THE INVENTION

The present invention relates to surface working apparatus and in particular, but not exclusively, to surface working apparatus having a surface working head arrangement with a plurality of surface working elements depending therefrom, which elements are particularly adapted for an operation such as burnishing and which elements particularly exhibit relatively limited flexibility/compressibility.

DESCRIPTION OF THE RELATED ART

Various versions of surface working apparatus are known which can be operated for tasks such as burnishing and wherein the surface working elements comprise pad members which exhibit a relative lack of compressibility/flexibility when compared with other surface working elements such as brushes etc.

In order to provide an efficient surface working apparatus, a surface working head arrangement is currently provided with has a plurality of such pads, or other surface working elements, depending therefrom such that a plurality of pads or other elements are operated simultaneously to achieve the surface working action required, be it burnishing, scrubbing, cleaning or polishing etc.

However, such apparatus is commonly required to operate over a variety of surfaces offering different characteristics and, in particular, different degrees of uniformity. For example, while some surfaces to be worked may comprise a relatively level and smooth surface, other surfaces, particularly those prone to excessive wear or potential damage, and/or older surfaces, may exhibit undulations such that a relatively uneven surface is presented for working.

Known surface working apparatus is disadvantageously limited in that the quality of surface working that can be achieved is limited since the plurality of surface working elements cannot adequately compensate for such uneven surfaces.

SUMMARY OF THE INVENTION

The present invention therefore seeks to provide a surface working apparatus having advantages over known such apparatus.

According to one aspect of the present invention there is provided surface working apparatus comprising a surface working head arrangement having a frame member and including a plurality of surface working members arranged to depend therefrom in the direction of the surface to be worked, wherein each of the said plurality of surface working members is mounted resiliently relative to the said frame member by one of a plurality of respective resilient mounting arrangements.

The independent, and resilient mounting of each of the surface working members, e.g. a pad member, advantageously allows for each of the surface working members to move relative to the frame member so as to compensate for undulations or unevenness in the surface being worked. Thus, whilst the frame member may be held at a constant level, determined by the pressure to be applied, over the undulating surface, the respective surface working members can move relative to that level so as to follow independently the undulations of the surface.

Drive means are associated with the surface working apparatus for driving the surface working members and such drive means are advantageously mounted to the frame member and the surface working members then resiliently mounted to the drive means. Most appropriately, a corresponding plurality of respective drive means is also provided on the surface working apparatus.

Preferably, the resilient mounting arrangement includes a compression spring which can be further advantageously arranged to be compressed to substantially half its length when the surface working head arrangement is exhibiting the particular required force on the surface being worked. Thus, the characteristics of the compression spring are advantageously matched to the particular nature of the surface working member associated therewith, be it a pad member, brush member or other appropriate member.

The resilient member is advantageously located between the drive shaft of the drive means and a surface working member drive adaptor means. Further, a drive motor adaptor is drivingly located between the motor drive shaft and the resilient member.

Preferably, the surface working drive adaptor means includes a hollow cylindrical housing member for receiving one end of the motor drive shaft adaptor.

The resilient means is then advantageously located within the cylindrical housing for contact between a lower surface thereof and a lower surface of the motor drive shaft adaptor.

Preferably, the resilient mounting arrangement is arranged to be selectively operative dependent upon the pressure to be exerted through the surface working head arrangement and to the surface to be worked. This is a particularly advantageous feature since, when pressure levels exceed those that might otherwise damage the resilient member of the resilient mounting arrangement, the further biasing of the resilient member is prevented so as to prevent damage thereto during the further increase in pressure to be applied to the surface. Thus, as the pressure is increased above the aforementioned threshold level, pressure is no longer applied by way of the resilient member of the surface working head arrangement.

The selective operation is achieved through movement of the resilient member within the mounting arrangement and into, and out of, a position in which it can be influenced by increases/decreases in pressure.

The resilient means advantageously moves out of its operative position, i.e. a position in which it can be further compressed, once the pressure applied through the surface working head arrangement exceeds a certain, and in particular predetermined, level.

Advantageously, the resilient mounting arrangement includes a housing provided with an engagement formation which is arranged to be engaged so as to prevent further biasing of the resilient member as the pressure to be applied to the surface increases.

The resilient member advantageously comprises a compression spring which can be arranged to be compressed to substantially half its length when the required pressure is to be applied to the surface by way of the surface working head arrangement.

Further, the aforementioned engagement formation can advantageously comprise a shoulder portion arranged adjacent the resilient member and, insofar as the housing includes a bore portion, the engagement formation can advantageously comprise an annular shoulder member which can further be in the form of an annular shoulder surrounding a well, or a cylindrical recess portion.

Advantageously, the housing arrangement is arranged for providing a driving connection to a drive member extending from a motor arrangement for the surface working member and, in particular, the resilient member is arranged to contact the underside of the aforementioned driving member.

Further, the resilient member may be associated with a contact plate for contacting the aforementioned driving member.

Yet further, the undersurface of the driving member which is arranged to contact the resilient member by way of the aforementioned contact plate, or otherwise, can advantageously be provided with a chamferred, partially convex, or part spherical surface which serves to assist with a gimbal-like movement of the housing member relative to the driving member extending from the motor.

With regard to a further advantage, the housing member is provided with a resilient clip means serving to retain the driving member extending from the motor arrangement within the housing.

Advantageously, the driving member has an engagement formation arranged to receive the clip means so as to prevent its removal from the housing. The aforementioned engagement formation of the driving member can advantageously be in the form of a shoulder portion of the driving shaft.

Advantageously, the transverse cross section of the driving shaft comprises a polygon and, in particular, a hexagon. In particular, it may comprise a star shape or an appropriate form of scalloped hexagon.

In any case, the transverse cross-section advantageously exhibits corner regions and a recess can be formed in a side wall portion of the bore that receives the driving member so as to guide and retain operative movement of the clip in the region of the shoulder portion of the driving shaft.

The clip means is advantageously arranged to be deformed so as to allow for entry/exit of the driving member relative to the housing and, in particular, it is the angled side walls defined by the hexagonal cross-section that serve as ramp means for at least a portion of the clip means so that, as the aforesaid portion is moved along the ramp means, the clip means is deformed outwardly relative the centre of the driving member so as to allow for its removal from the housing.

The present invention also advantageously provides for a surface working device such as a pad or brush which can be employed in apparatus as defined above.

Thus, in accordance with another aspect of the present invention there is provided a surface working device comprising a support plate from which a surface working element is to depend from a lower surface thereof, said support plate including an upper surface which has a central region with a recess provided therein for the receipt of a drive member for rotating the device, wherein the recess includes a formation for receiving a resilient member intended for engagement by the drive member.

The formation provided in the recess advantageously serves to engage at least one portion of the resilient member such that another portion of the resilient member can be engaged by the drive member so that relative movement between the drive member and the support plate can be achieved whilst deforming the resilient member.

Advantageously, the said central region comprises an upstanding region with the recess provided therein. If required, the recess can therefore be provided within the upstanding central region so that the depth of the recess is not dependent upon the thickness of the support plate.

In particular, the upstanding region can comprise an upstanding cylindrical member having the recess formed therein and which is coaxial with the support plate.

While the support plate can itself be provided with formations for receiving the portion defining the said central region, the central region defining the recess can advantageously be formed integral with the support plate.

In one particular embodiment, the said recess comprises a substantially blind bore which may advantageously have an end surface exhibiting a generally concave profile.

The generally concave profile can advantageously serve to enhance any gimballing effect that may be required between the drive member and the device.

Preferably, the said formation for receiving the resilient member can itself comprise a further recess which, advantageously, can be formed coaxially with the said recess formed at the central region of the support plate.

The said further recess can advantageously be in the form of a substantially blind bore. In any case, the depth of the recess is chosen so as to determine the maximum deformation of the resilient member.

Advantageously, the resilient member can comprise a compression spring which is arranged to extend coaxially with the said further recess and the recess provided in the said central region of the support plate.

In one particular embodiment, the recess provided in the central region of the support plate has a substantially hexagonal lateral cross-section and is arranged for receiving a substantially hexagonal head of the drive member.

The depth of the recess formed in the central region is advantageously formed to be at least slightly greater than the depth of the head of the drive member. In this manner, the said central region of the support plate can be advantageously provided with a spring retaining clip which requires deformation to allow the drive head into, or out of, the recess formed within the central region of the support plate.

The present invention is particularly advantageous when embodied with a surface working head arrangement exhibiting at least three surface working members which, when viewed from above, can be provided in a triangular formation on the frame of the surface working head arrangement. As mentioned before, such surface working members advantageously comprise pads, which, in particular, are arranged for burnishing of the surface to be worked.

In the aforementioned manner, the frame member of the surface working head arrangement can comprise a laterally extending deck member having a plurality of drive motors extending from the upper surface thereof and a plurality of respective surface working members extending from the lower surface thereof aligned with the motors.

Advantageously, the surface working apparatus Comprises a machine frame supporting a motor-driven surface working head arrangement, means for selectively varying the pressure exerted by said head arrangement on said surface, and means for selectively varying the speed at which said head arrangement is driven by said motor.

Preferably, the surface working head arrangement is adapted for the releasable mounting of a variety of surface working elements. Further, the surface working head arrangement can be arranged for releasable mounting of a plurality of surface working members each having different surface working characteristics.

The means for selectively varying the pressure exerted by the surface working head can be arranged to alter said pressure in response to use of said surface working head means exhibiting different working characteristics.

Further, the means for selectively varying the speed at which said head arrangement is driven by said motor may be arranged such that said speed can be altered in response to use of said surface working head means exhibiting different characteristics.

Advantageously, the apparatus includes actuator arrangement comprising spring means mounted to act as suspension means including means for biasing the surface working head arrangement towards a surface to be worked, tensioning means for tensioning the spring means so as to set the pressure of the surface working head arrangement and wherein the spring means is selectively adjustable by the tensioning means over a continuous range to provide a required bias towards the surface.

The tensioning means may include means for controlling the tension in the spring means so as to vary the bias of the surface working head arrangement. Also, the actuator arrangement can be arranged to compress the spring means.

The apparatus may further include biasing means acting between the frame and the surface working head arrangement to apply to the surface working head arrangement a selectable bias towards the surface to be worked and mounted to act as suspension means between the frame and the surface working head arrangement, means for monitoring and/or measuring the applied working pressure, means for displaying an indication of the measured working pressure, means for operator entry of a desired working pressure for the surface working head arrangement and, comparator means for comparing the operator input pressure to the measured pressure and for generating a control signal in response to the difference between the desired pressure and the measured pressure and means for applying the control signal to the pressure applying means.

The means for selectively varying the pressure applied to the surface by said surface working head arrangement can comprise biasing means acting between the frame and said surface working head arrangement and comprising an actuator having a first member, and a second member extendible therefrom and which actuator is further preferably operable manually, hydraulically or electrically.

The biasing means advantageously comprises a spring means which may further include at least one spring device acting between a portion of the actuator and the surface working head arrangement. The spring device can comprise a sleeve secured to said portion of said actuator means, a rod having an inner end slidable within the sleeve, the rod projecting from the sleeve to the surface working head arrangement, and a spring located within the sleeve engaging the inner end of the rod.

Further, the apparatus can include an actuator arrangement for raising and lowering the surface working head arrangement and mounted between the frame and the surface working head arrangement, and means operatively connected to the surface working head arrangement and arranged to at least partially counteract the force to be exerted via the surface working head arrangement on the surface, and so as to control the pressure exerted by the surface working head arrangement on the surface to a range which includes zero pressure to a pressure corresponding to the weight of the surface working head arrangement.

In particular, the means for counteracting the force exerted on the surface working head arrangement by the actuator can comprise counterbalancing means.

The means for counteracting can comprise resilient means operatively connected to the surface working head arrangement.

Advantageously, the resilience of the resilient means is selectively variable.

Preferably, the resilient means comprises at least two relatively moveable members which are arranged to be relatively movable in a resilient manner. The resilient means advantageously comprises a cylinder and piston arrangement.

The resilient means can then comprise a gas strut arrangement.

Alternatively, the resilient means can comprise spring means.

As a further alternative, the means for selectively varying the pressure exerted by the surface working head arrangement comprises an elongate balance beam pivotally connected to the frame and connected at one end to the actuator for movement therewith, and at the other end having a counter balance mounted thereon.

The means for selectively varying the speed at which the head arrangement is driven can comprise a selective plurality of gear arrangements having gear ratios determined on the basis of the working operations required.

The gearing arrangement preferably comprises respective pairs of gears in constant mesh and means for selecting one of said pairs for delivering the upward drive from said gearbox.

The means for selecting said one of said pairs advantageously comprises clutch means in the form of dog-clutch means.

The apparatus can further include control means comprising a solenoid actuator arranged to be retained in its two or more possible operative positions by solenoid locking means.

Preferably, means for controlling switching in the gearbox and which is associated with the means for selecting the pressure applied by way of the surface working head arrangement can be provided so that the switching of the gearbox is achieved in response to the selection of particular pressure values either above or below one or more threshold values or the selection of specific values.

Preferably, the apparatus has a control arrangement arranged such that the selection of any particular pressure value or range is responsive to switching of the gearbox. Further, the gearing arrangement advantageously comprises a first gear pair with a 1:1 ratio and a second gear pair with a 5:1 ratio.

Control means can be provided to inhibit the change in the gearing mechanism while the motor is driving the surface head arrangement. In particular, the control means is arranged to limit the pressure that can be applied by way of the surface working head arrangement once the high speed gear ratio is selected.

Advantageously, the apparatus comprises a combined floor scrubber/burnisher machine.

BRIEF DESCRIPTION OF THE DRAWINGS

The invention is described further hereinafter, by way of example only, with reference to the accompanying drawings in which:

FIGS. 6A–6E illustrate a mounting formation of a surface working member according to, and also a spring latch member associated with, an embodiment of the present invention;

FIG. 12 is a plan view of the central region of a surface working device embodying one aspect of the present invention and as shown in longitudinal cross-section in FIG. 13;

FIG. 15 is a side elevational view of a drive member for rotatably driving the device of FIGS. 12–15;

FIG. 16 is a plan view of the drive member of FIG. 15; and

DESCRIPTION OF THE PREFERRED EMBODIMENTS

Figure 1:
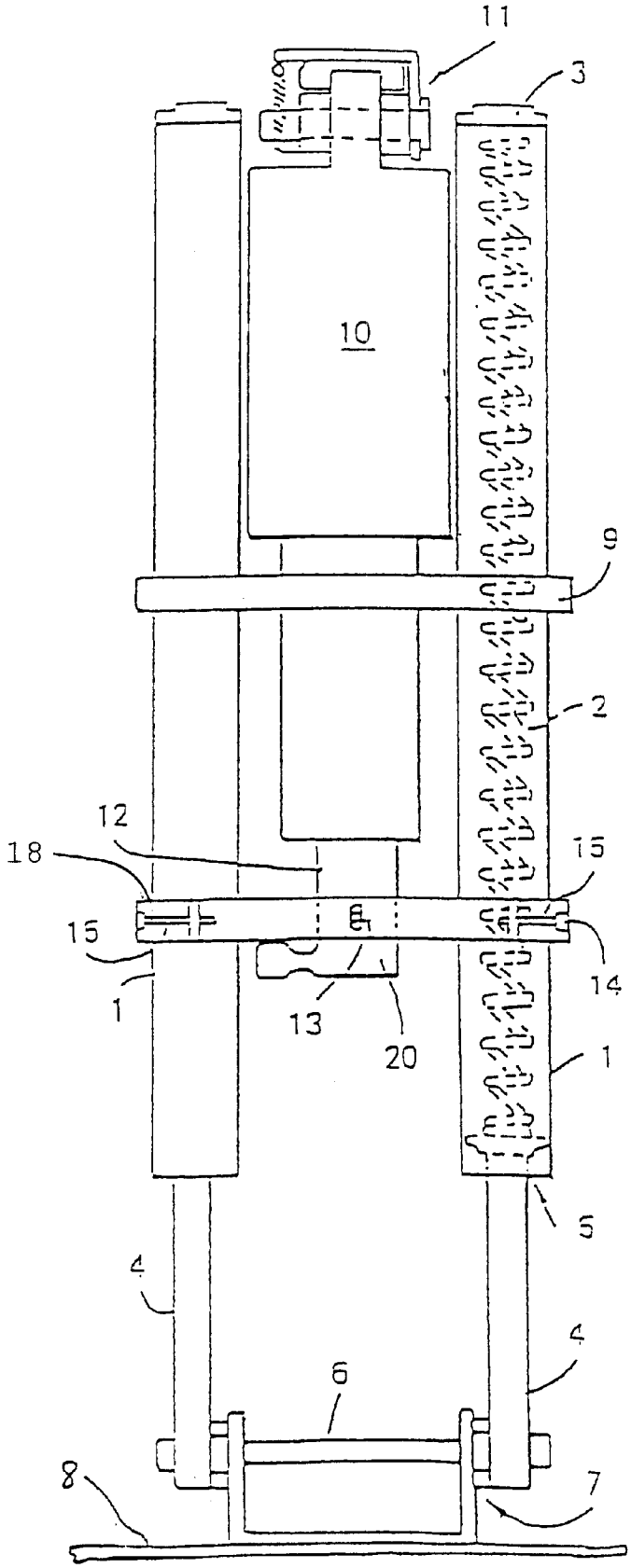
FIG. 1 shows a cross-sectional elevational view of part of a surface working head arrangement and associated actuator embodying the present invention.

In FIG. 1, the brush/pad assembly comprises two spring tubes 1, containing springs 2. The right hand tube 1 in FIG. 1 is shown in cut-away to illustrate spring 2. Each spring is fixed at one end to the upper end of the tubes at 3 and at the other end to a spring rod 4 which slides through an aperture 5 into the respective spring tube 1. The spring rods 4 are connected together by a bolt 6 and are fixed via assembly 7 to the brush/pad support deck 8 to which brush head or pads etc can be connected. The brush or pads are releasably secured to the assembly so as to allow for ready replacement by other heads as required.

The tubes 1 are prevented from rotating or skewing by a steadying plate 9. An actuator 10 is secured to a bulkhead of a cleaning machine. Actuator 10 drives actuator rod 12 which is shown in substantially closed up position in the Figure. The actuator rod 12 is fixed by a pin 13 to actuator plate 14 which is clamped to both spring tubes 1 by clamping bolts 15. Thus as the actuator drives the actuator rod 12 downwards, the spring tubes 1 move downwards and the springs 2 are compressed causing a higher pressure to be exerted on the brush head assembly whilst still providing suspension to accommodate uneven floors and brush wear. Typically, the effective spring lengths, in an uncompressed state, are around 15 inches and this is particularly suitable for a 26/32 inch brush pressure system. Such an arrangement can provide a range of 0 to 450 lb pressure in a loaded pedestrian cleaning machine fitted with apparatus according to the invention, compared to the maximum 200 lb pressure available using known apparatus. Of course other forms of biasing means could be used. A torsion spring has the advantage of taking up less vertical space in a cleaning machine. Also, a torsion spring generally has a low spring rate which is particularly suitable for this purpose. Gas struts or hydraulic or pneumatic systems could also be used.

The pressure can be further adjusted by changing the springs for different length ones or different strengths since the clamping position of the spring tubes can be altered. However these changes require a service engineer.

The system is particularly adjustable since the actuator can be stopped anywhere in its stroke.

Usually support deck 8 will have attached at least two circular or elliptical brushes or pads rotating in a plane generally parallel to the floor (or surface to be cleaned or swept or scrubbed). However, up to four brushes or pads are in use in some cleaning machines and the apparatus of the invention could be used to control all such four brushes together or alternatively individually (in which case separate actuators would be used for each). Of course a cylindrical brush head could equally easily be controlled mounted on the brush support deck 8 or alternatively controlled at each end of its shaft by respective separate assemblies according to FIG. 1.

A strain gauge beam 20 which may be used to measure the brush/pad pressure is located under the spring tube clamp plate 18.

Figure 2:
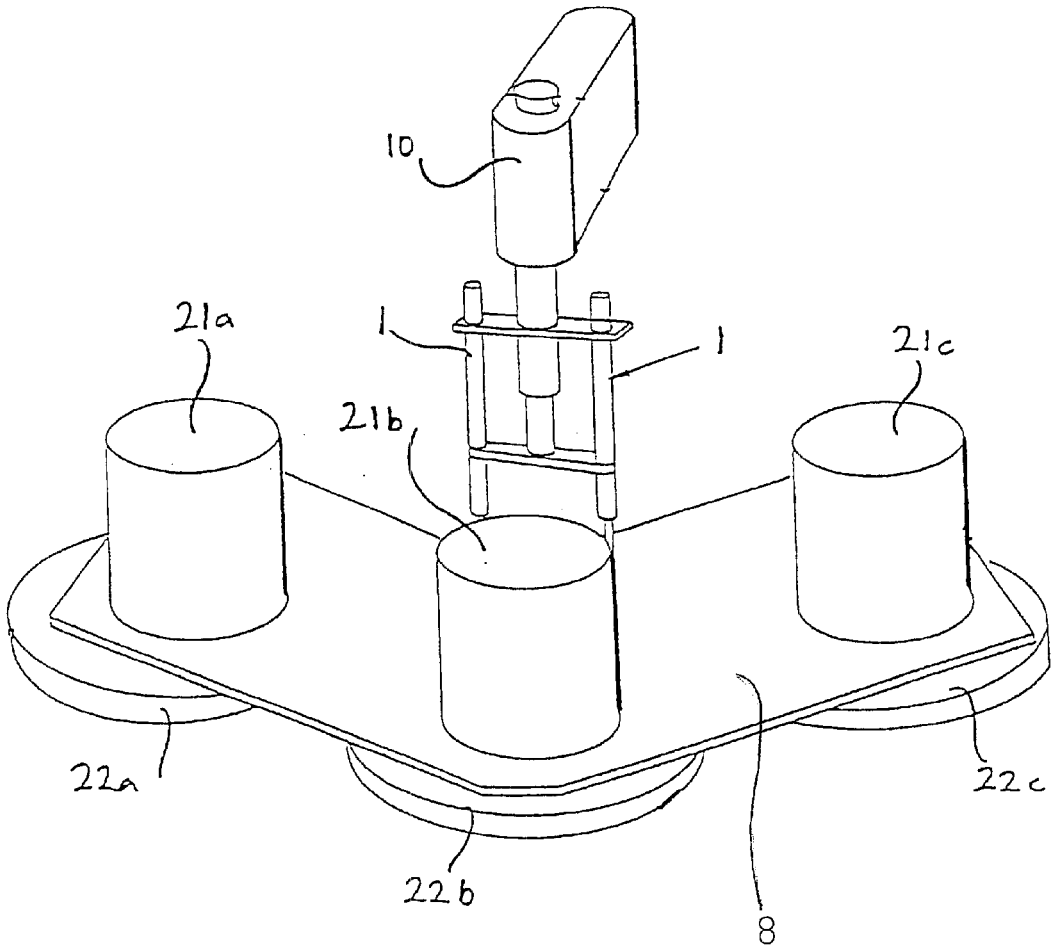
FIG. 2 is a perspective view of a surface working head arrangement embodying the present invention and arranged for operation with the actuator of FIG. 1.

FIG. 2 is a perspective view of a surface working head arrangement for use with an actuator arrangement such as that illustrated in FIG. 1 and which includes the spring tubes 1 and actuator 10 illustrated further in FIG. 1.

The surface working head arrangement also includes the brush/pad deck 8 illustrated in FIG. 1 and has three electric drive motors 21*a*, 21*b*, 21*c* mounted on the other surface of the deck 8. Three corresponding brush/pad heads 22*a*, 22*b*, 22*c* extend from beneath the deck and are drivingly connected, by way of respective drive shafts, to the respective motors 21*a*, 21*b*, 21*c*.

As will be appreciated from the triangular formation of the three motors 21*a*, 21*b*, 21*c* and associated brush/pad heads 22*a*, 22*b*, 22*c* a predetermined overlap is achieved between brush/pad heads 22*a* and 22*b* and between brush/pad head 22*b* and 22*c* so that the brush/pad head arrangement of FIG. 2 can serve to clean, sweep, polish, burnish, or otherwise work, a surface to the full width defined by the separation of the outer circumferential edges of the brush/pads 22*a*, 22*c*.

Figure 3:
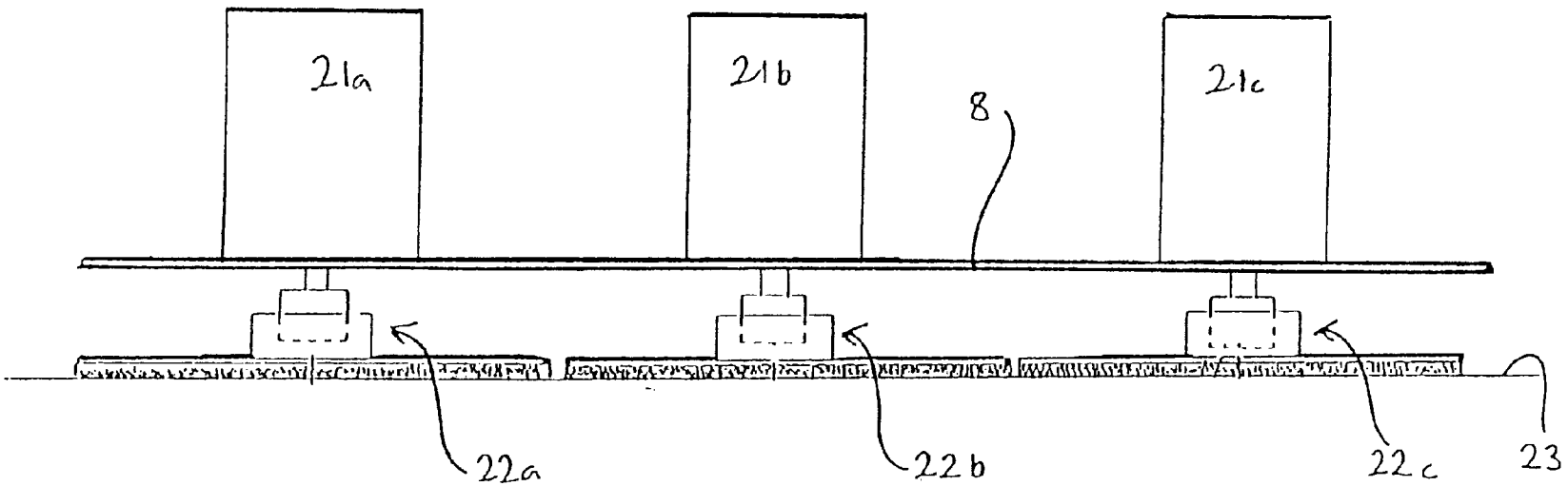
FIG. 3 is a side elevational view of the deck arrangement of the surface working head arrangement of FIG. 2.

The width, when viewed in a surface working direction is illustrated further by way of FIG. 3 which is a front elevational view of merely the deck 8, motors 21*a*, 21*b*, 21*c* and brush/pad heads 22*a*, 22*b*, 22*c* when in use for working, for example burnishing, a surface 23.

Indeed, FIG. 3 illustrates a particularly important aspect of the present invention in that it will be appreciated that, due to undulations in the surface 23 being burnished, the surface presents a somewhat uneven surface to the burnishing apparatus such that the surface 23 does not extend in a uniform parallel manner in relation to the lateral extension of the deck 8.

Thus, the distance between the undersurface of the deck 8 and the surface being worked 23 is, due to undulations and unevenness, less in the right hand region of FIG. 3 than in the left hand region.

With prior art apparatus, this would lead to the region of the surface 23 beneath the motors 21*a* and 21*b* not being satisfactorily burnished, or otherwise worked, so that the whole surface 23 might not be satisfactorily worked or, at best, might require a greater number of passes using the apparatus which then offsets the advantages generally found from using a multi-head burnishing or surface working apparatus.

As mentioned, FIG. 3 illustrates a particularly important aspect of the present invention which is discussed in further detail below. However, from FIG. 3, it will be appreciated that each of the brush/pad heads 22*a*, 22*b*, 22*c* mounted beneath the deck 8 is mounted in a dependent manner moveable relative to the deck 8 so that the depth to which the pads/heads 22*a*, 22*b*, 22*c* extend beneath the deck 8 can vary independently and follow undulations in the surface being worked such as that illustrated in the surface 23 of FIG. 3.

Thus, even the undulations in surface 23 can be satisfactorily worked by way of the brush/pad heads 22*a*, 22*b*, 22*c* such that the advantages achieved by using a multi-head arrangement can be maintained even when working an undulating or otherwise uneven surface.

Figure 4:
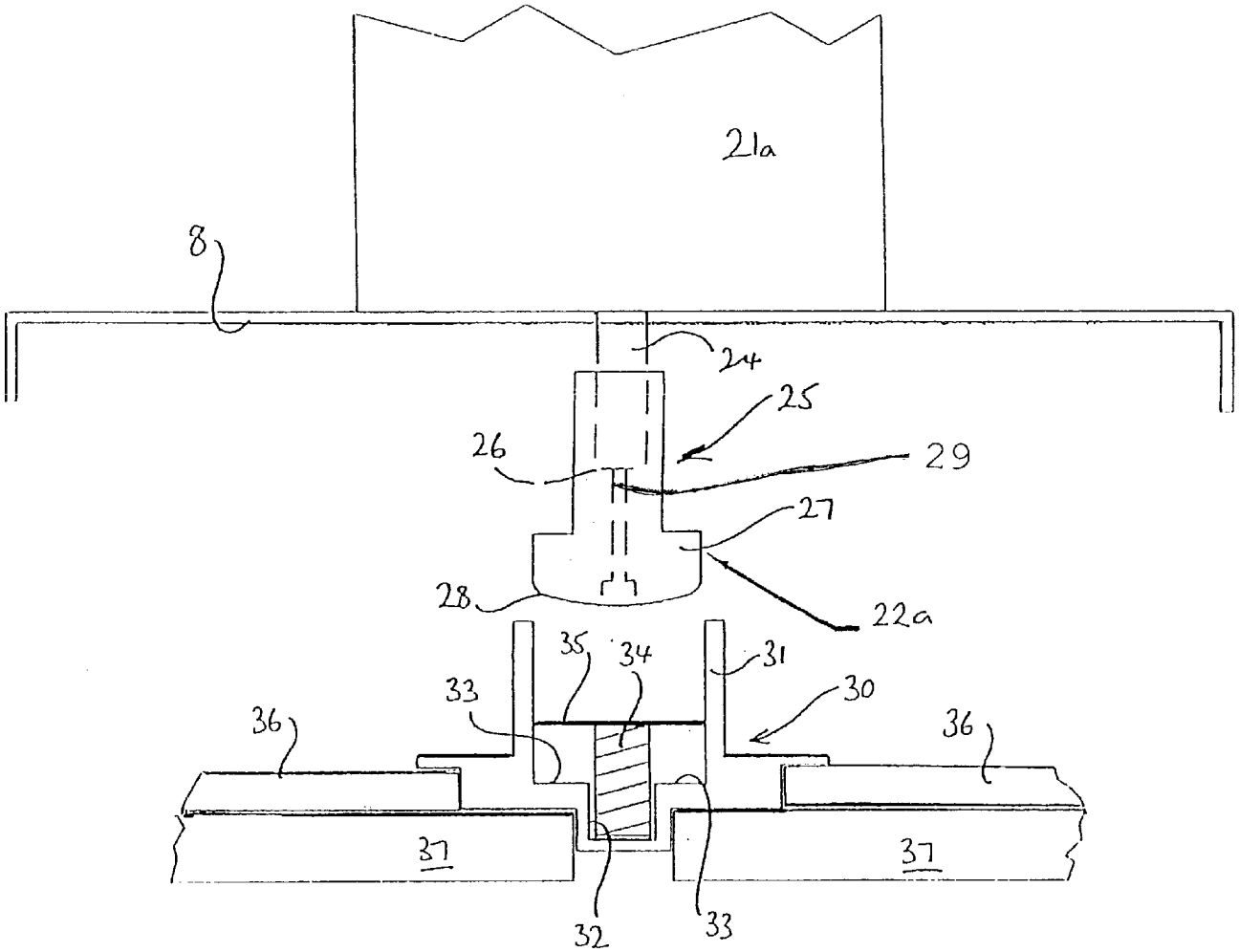
FIG. 4 is a schematic exploded view of one of the surface working members of the surface working head arrangement of FIGS. 2 and 3.

FIG. 4 shows in greater detail one of the independent mounting arrangements employed within the embodiment of the present invention illustrated herein and so only one 21*a*, 22*a* of the motors and brush/pad heads is illustrated in FIG. 4.

A motor drive shaft 24 extends downwardly from the motor 21*a* and through an appropriate aperture formed in deck 8 and is received in a female engagement portion of a drive shaft adaptor 25. The motor drive shaft 24 is advantageously keyed into the drive shaft adaptor 25.

The drive shaft adaptor 25 includes an upper cylindrical portion 26 and a head portion 27 having a hexagonal transverse cross section. The hexagonal head portion 27 has an undersurface which is rounded in some manner so as to provide a chamferred or otherwise formed as a convex, or part spherical, surface 28 and the drive shaft adaptor 25 is further provided with a bore 29 extending along the longitudinal axis thereof into which the motor drive shaft 24 is keyed.

The shaping of this lower surface serves to assist in permitting the movement of the brush/pad heads in a slightly pivoted manner relative to the deck 8 to further follow changes in the inclination of regions of the surface being worked.

The drive shaft adaptor 25 is arranged to be received within a drive plate adaptor 30 for driving engagement therewith. The drive plate adaptor 30 includes an upstanding collar portion 31 having a cylindrical outer surface and presenting an inner bore with a hexagonal transverse cross section arranged to correspond to the hexagonal cross section of the head portion 27 of the drive shaft adaptor 25. The lower region of the bore formed by the collar portion 31 is provided with a cylindrical well 32 which likewise defines shoulder portions 33 in the regions within the bore of the collar portion 31.

A compression spring is inserted in the well 32 so as to be received, and retained, therein and the end of the compression spring 34 remote from the well 32 is provided with a hexagonal contact plate 35, such as a star shaped or scalloped hexagonal shaped contact plate, which is arranged to contact the under surface 28 of the drive shaft adaptor 25 as it is inserted into the collar portion 31 of the drive plate adaptor 30.

By virtue of the respective hexagonal or star shaped cross sections for the inner surface of the collar portion 31 and the head portion 27 of the drive shaft adaptor 25, the drive shaft adaptor 25 is effectively keyed into the drive plate adaptor 30 so as to drivingly rotate the drive plate adaptor 30. The drive plate adaptor 30 is connected to an annular drive plate 36 which, in turn, has an annular burnishing pad 37 mounted thereon. Thus, rotation of the motor drive shaft 24 effects rotation of the burnishing pad 37.

Figure 5A:
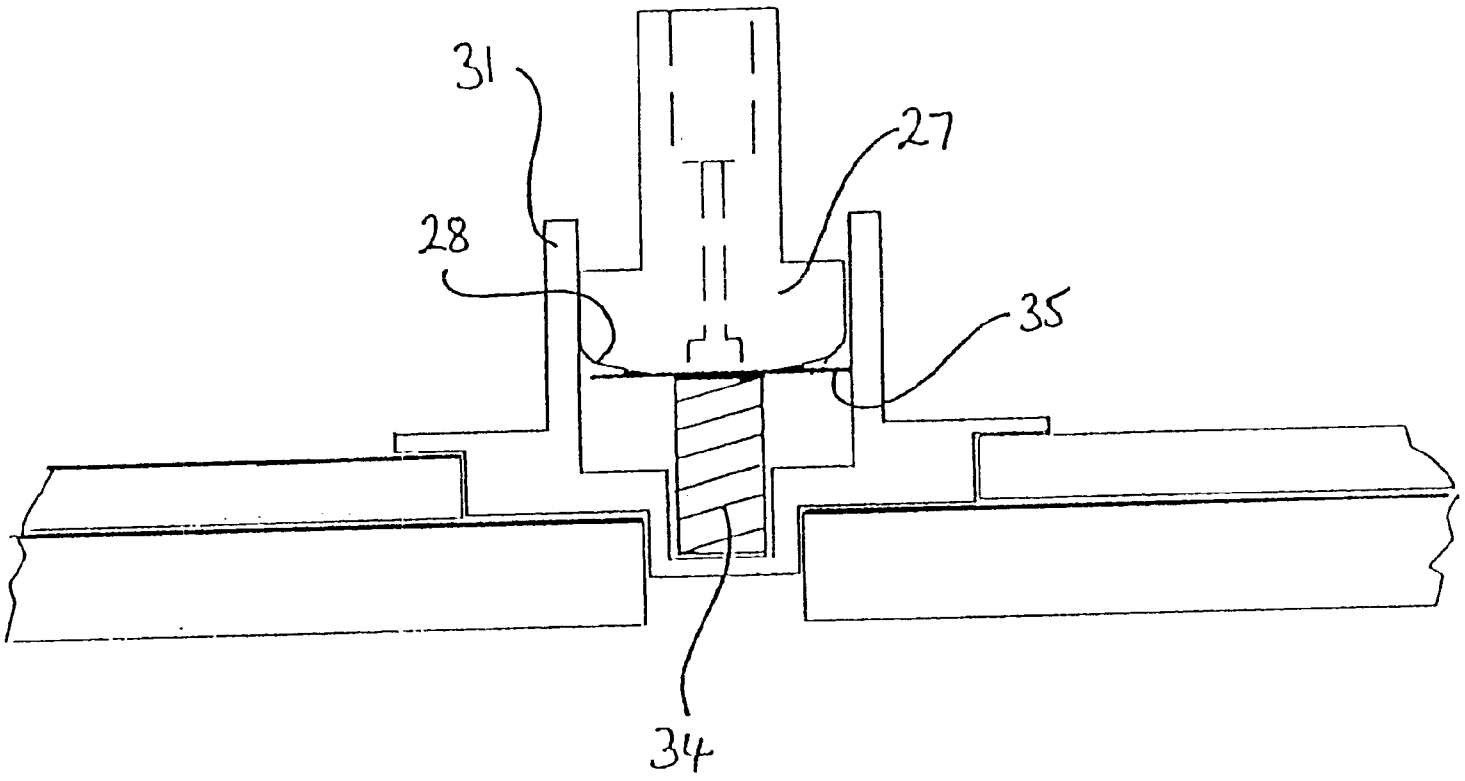
FIGS. 5A–5C are schematic views of the surface working member of FIG. 4 at different stages in the operation of the apparatus embodying the present invention.
Figure 5B:
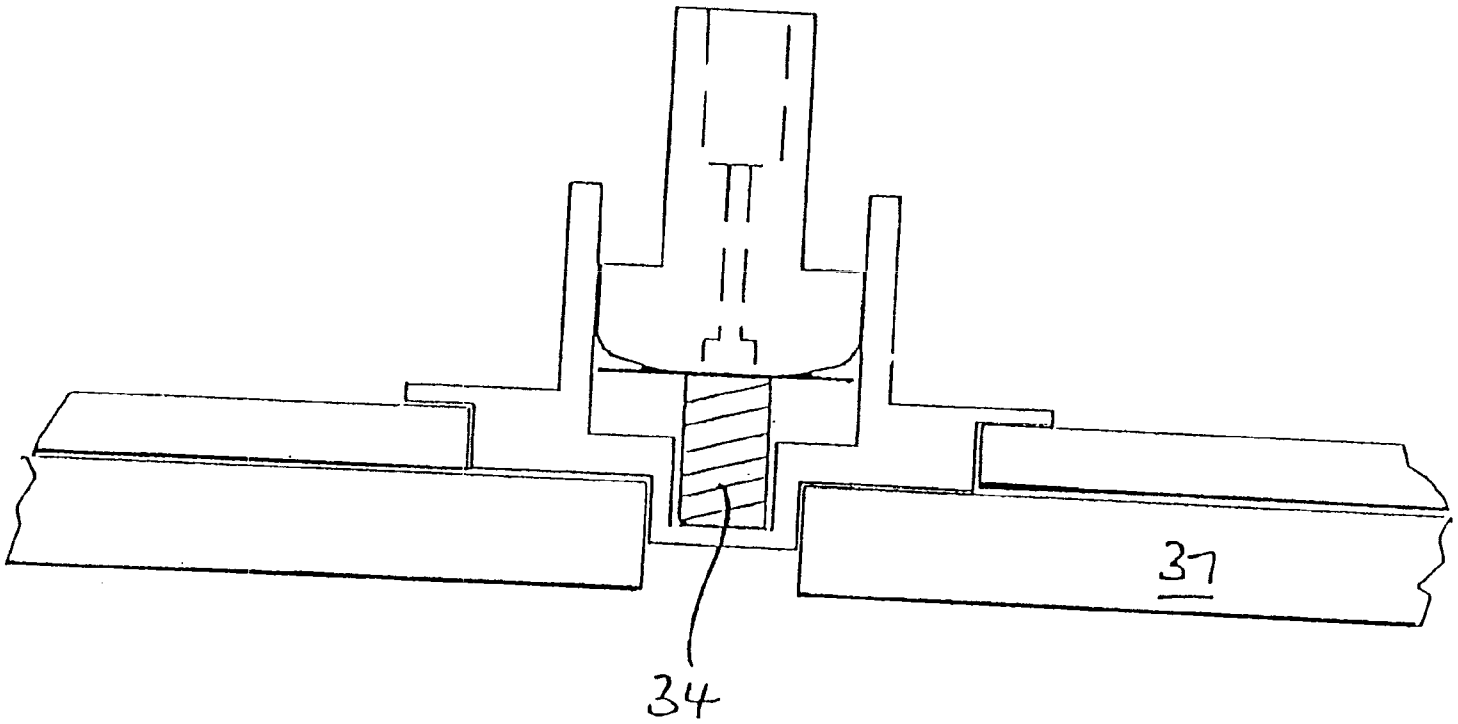
Figure 5C:
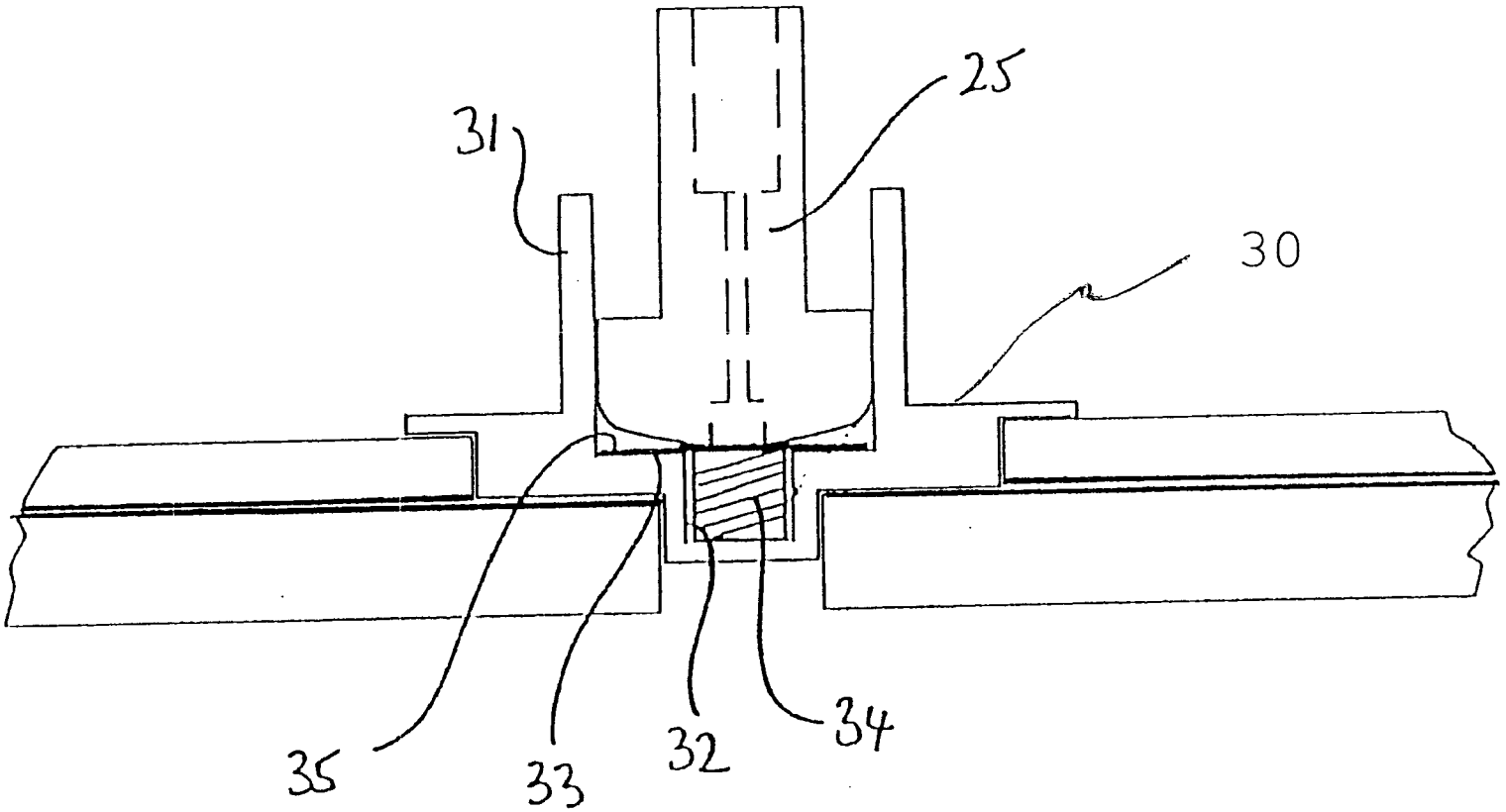

FIGS. 5A, 5B and 5C provide a further illustration of the resilient mounting arrangement for each of the brush/pads of the present invention. In FIG. 5A, the mounting arrangement of FIG. 4 is shown in greater detail but without reference to the motor 21*a* and the brush/pad deck 8 and with the drive shaft adaptor 25 inserted into the collar portion 31 such that the rounded undersurface 28 of the head portion 27 contacts the contact plate 35 associated with the compression spring 34.

This drawing would typically represent the positions of the various elements of the mounting arrangement if known pressure were to be applied through the actuator 10 of the brush head arrangement.

In FIG. 5B, the features of FIG. 5A are shown but this time with the compression spring 34 being partially compressed under light pressure. The compression spring 34 is advantageously provided such that it is arranged to compressed to substantially half its length when the pressure appropriate to the particular surface working action is to be applied and, as will be appreciated, compression of the compression spring 34 allows for the annular pad 37 to move downwardly relative to the deck 8 should any undulations in the surface being worked be encountered.

FIG. 5C illustrates a further aspect of the present invention in that, when the apparatus is controlled so as to exert a heavy scrub pressure, the compression of the compression spring 34 is limited in view of its location within the well 32 of the drive plate adaptor 30. As will be appreciated from FIG. 5C under such heavy pressures, the drive shaft adaptor 25 is moved to the maximum extent into the bore of the collar portion 31 so that the hexagonal contact plate 35 abuts against the shoulder portions 33 of the inner surface of the collar portion 31 adjacent the well 32. As the pressure increases further, it will be appreciated the pressure exerted by way of the drive shaft adaptor 25 is exerted directly on to the drive plate adaptor 30, by way of the hexagonal contact plate 35, and no further compression of the compression spring 34 occurs. It is therefore important that the depth of the well 32 correspond to a length for the compression spring 34 that can be readily achieved without the compression spring 34 being damaged.

FIG. 6A which represents a further plan view of the mounting arrangement for a surface working head of the present invention and illustrates a plan view of the drive shaft adaptor 25 located within the collar portion 31 of the drive plate adaptor 30.

As will be seen, a rectilinear latch spring 38 (see FIG. 6C) is illustrated and which is formed so as to extend over two of the corners formed on the star shaped, or scalloped hexagonal shaped, upper surface of the head portion 27 of the drive shaft adaptor 25.

In this manner, the drive shaft adaptor 25 is retained within the collar portion 31 of the drive plate adaptor 30.

However, the latch spring member 38 comprises a resilient member which can be deformed so as to allow for entry into, or exit from, the bore formed with the collar portion 31.

The rectilinear latch spring 38 is provided with a detent portion 39 by means of which it can be pulled in the direction of arrow A in FIG. 6A. Pulling the latch spring arrangement 38 in the direction of arrow A so as to move lateral leg portions which extend down the side walls of the head portion 27, outwardly along a line of travel defined by the outer walls of the star shaped cross section of the head portion 27 so that the laterally extending portion of the latch spring 38 is moved outwardly from its position above the upper surface of the head portion 27. This release position for the latch spring 38 once having been moved in the direction of arrow A is illustrated by the chain dotted representation of the latch spring 38 in FIG. 6A.

In FIG. 6B, there is illustrated a cross section of one particular version of the drive plate adaptor 30 according to the embodiment of the present invention and which includes a pair of recesses 40 provided in operations of the outer surfaces of the collar portion 31 of the drive plate adaptor 30.

Figure 6C:
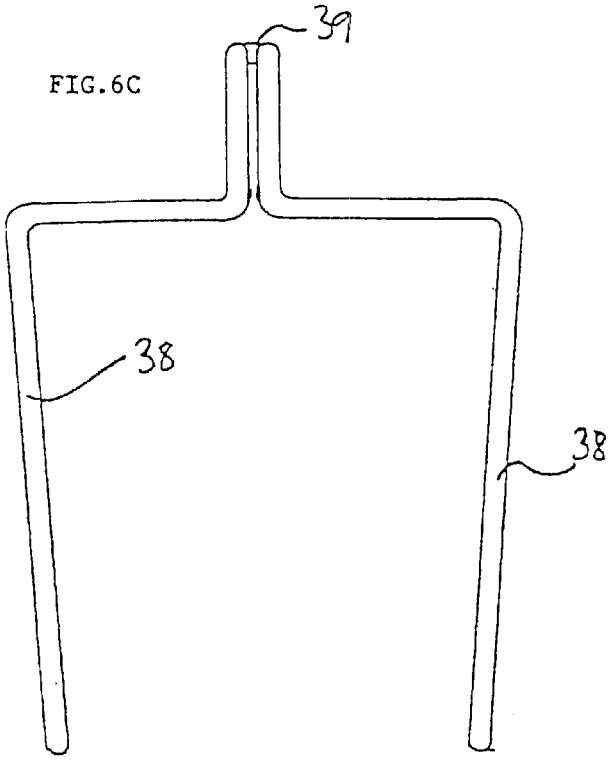
Figure 6E:
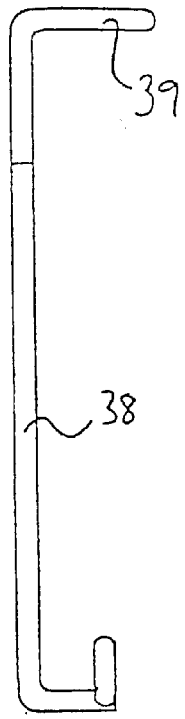
Figure 6D:
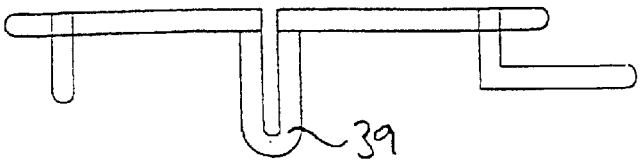

FIGS. 6C, 6D and 6E are plan side and end views of the latch spring 38 discussed above.

It will be appreciated that the latch spring 38 is received within the recesses 40 when in the retaining position shown in FIG. 6A so as to extend over the corner portions of the upper surface of the head portion 27. However, the latch spring 38 can readily move laterally within the recesses 40 so as to allow for the aforementioned opening of the latch spring 38 to allow for the release of the drive shaft adaptor 25 from the collar portion 31 of the drive plate adaptor 30.

The latch spring arrangement 38 is a particularly advantageous feature of the present invention which allows for the ready "snap-fit" of the head portion 27 of the drive shaft adaptor 25 within the collar portion 31 of the drive plate adaptor 30 and the ready removal therefrom when the surface working member, such as a pad or brush is to be replaced.

Figure 7:
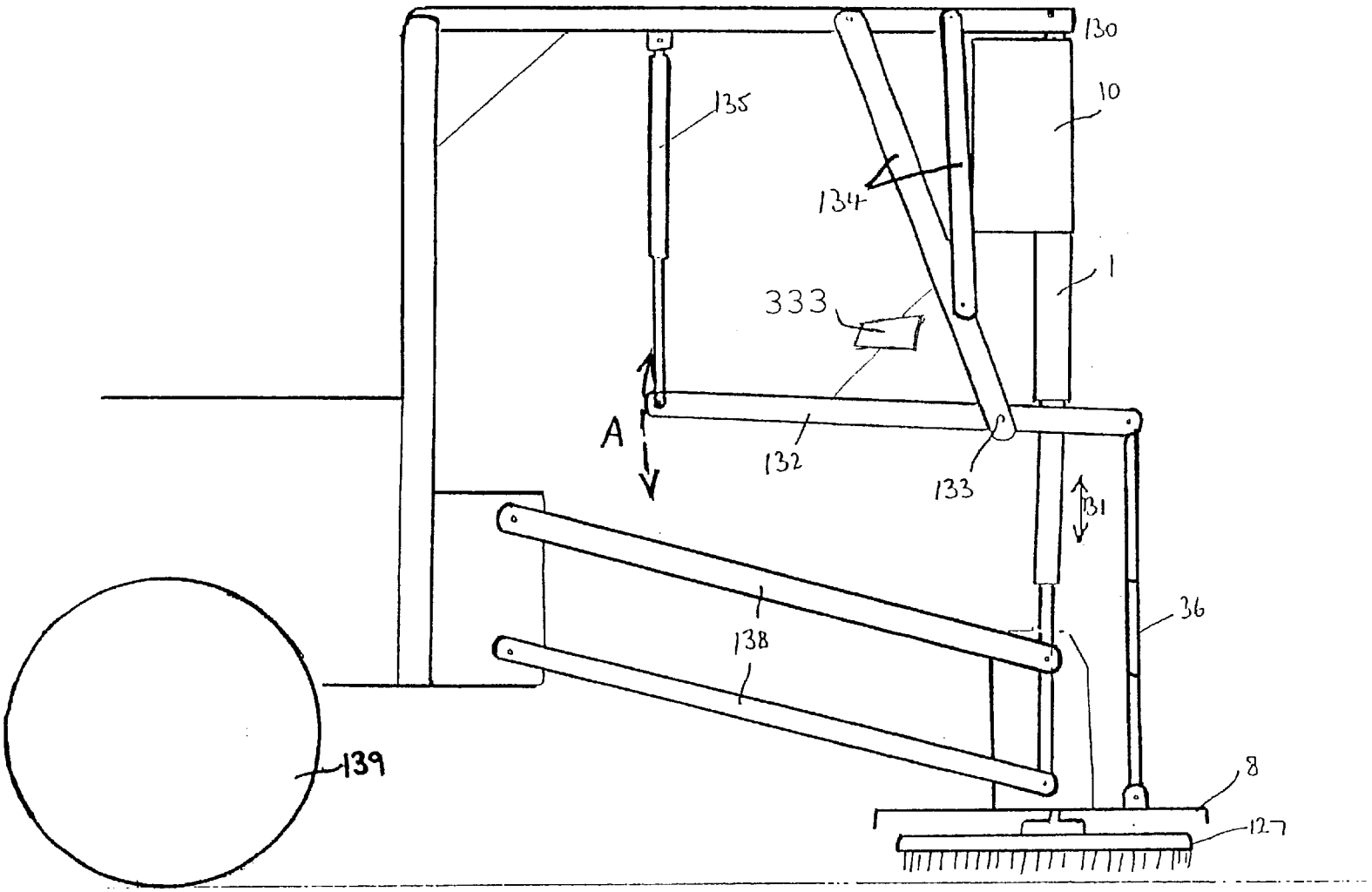
FIG. 7 is a side view of a brush/pad pressure assembly associated with the apparatus of the present invention.
Figure 8:
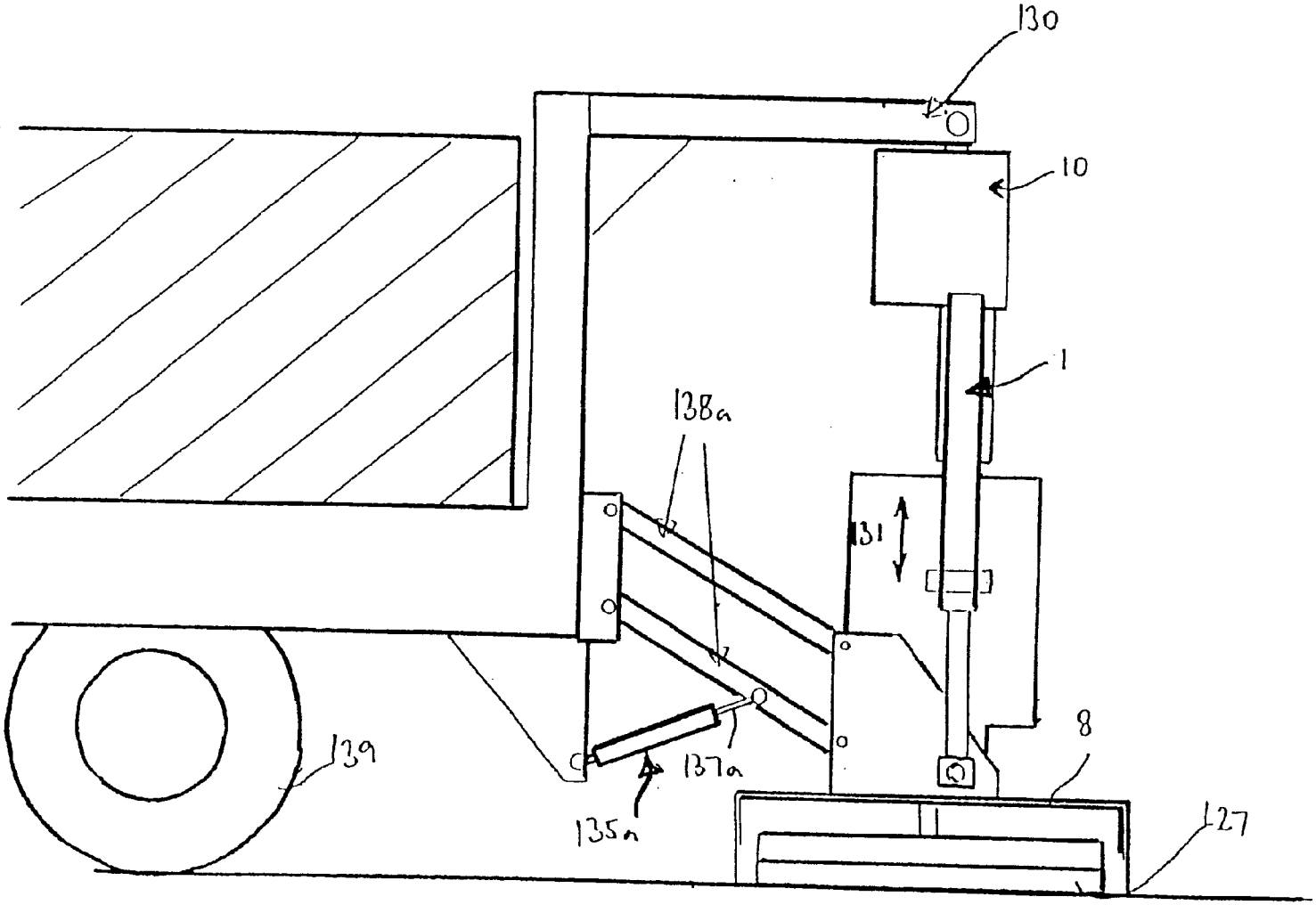
FIG. 8 is a side view of another version of a brush/pad pressure assembly associated with the embodiment of the present invention.
Figure 9:
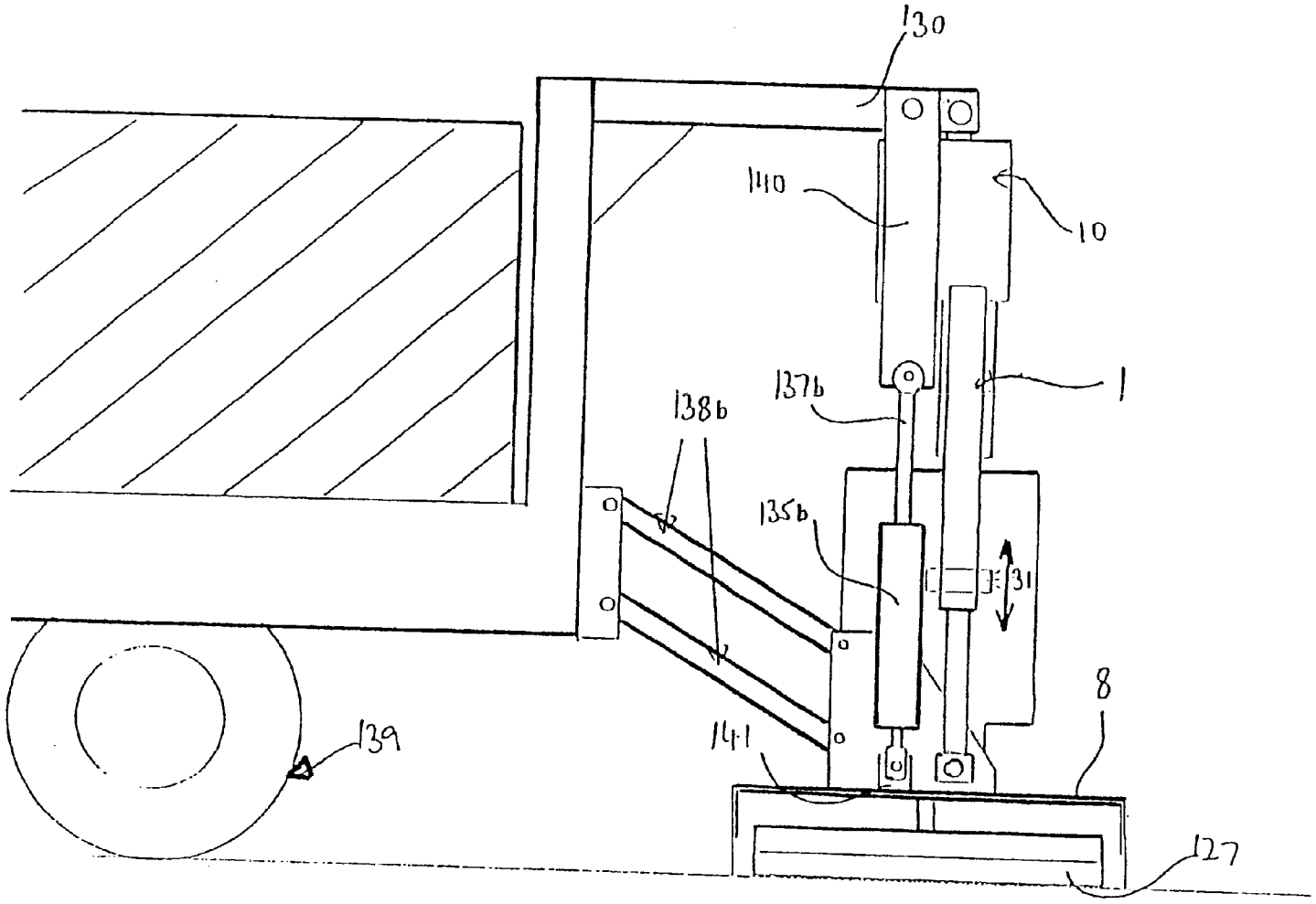
FIG. 9 is a side view of yet another version of a brush/pad pressure assembly associated with an embodiment of the present invention.
Figure 10A:
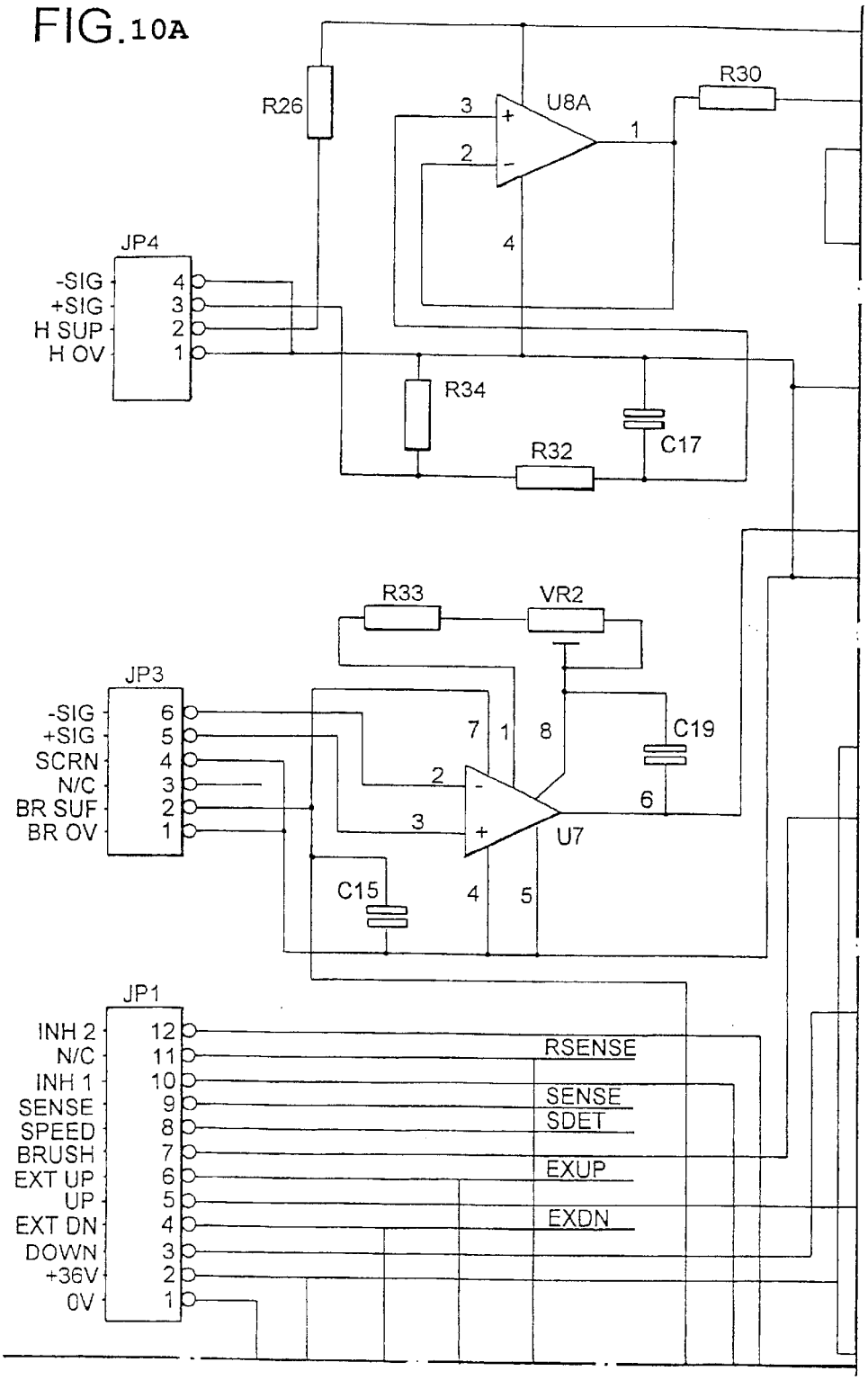
FIGS. 10A–10H comprise a circuit diagram illustrating control means that can be associated with apparatus embodying the present invention.
Figure 10B:
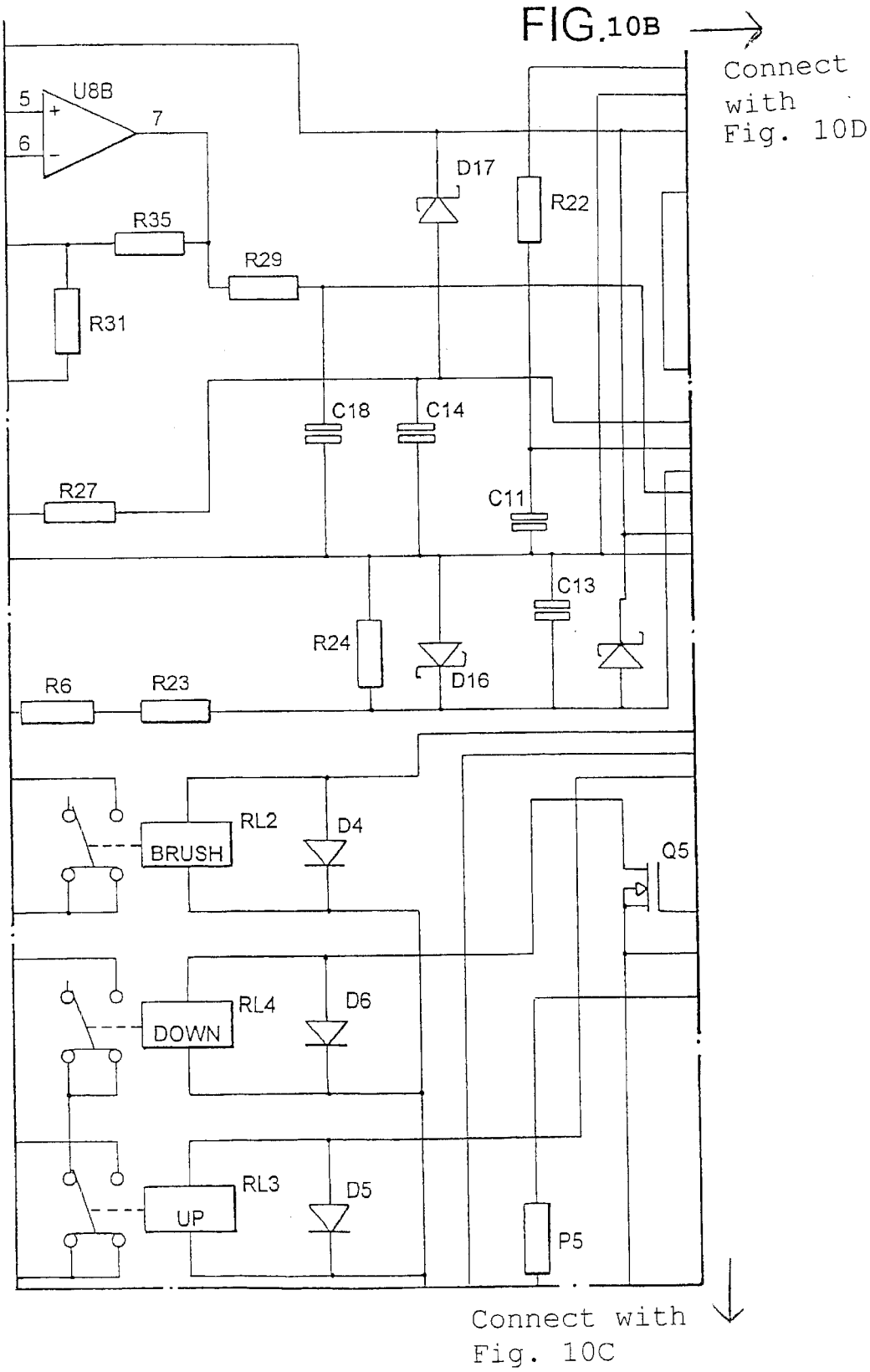
Figure 10C:
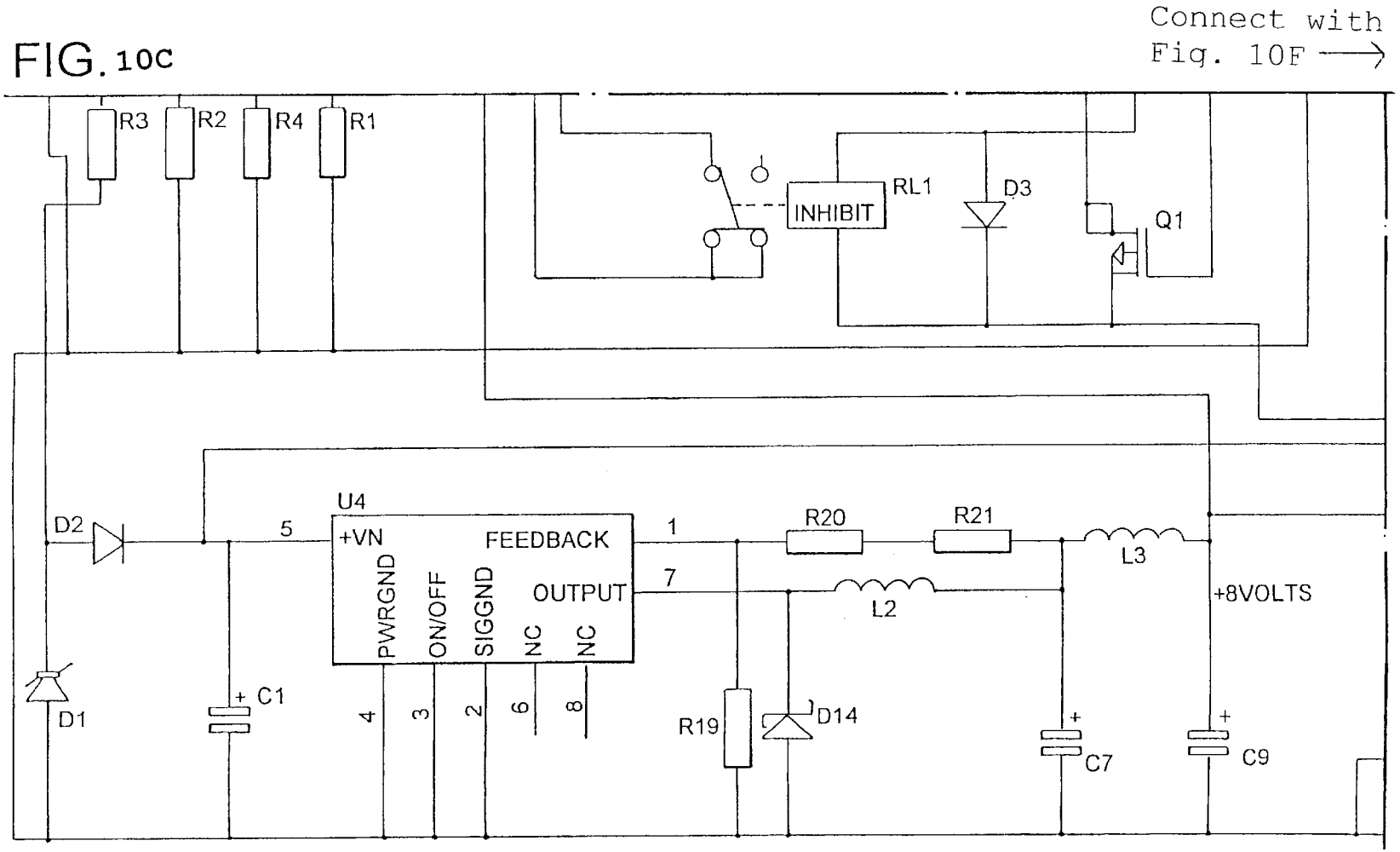
Figure 10D:
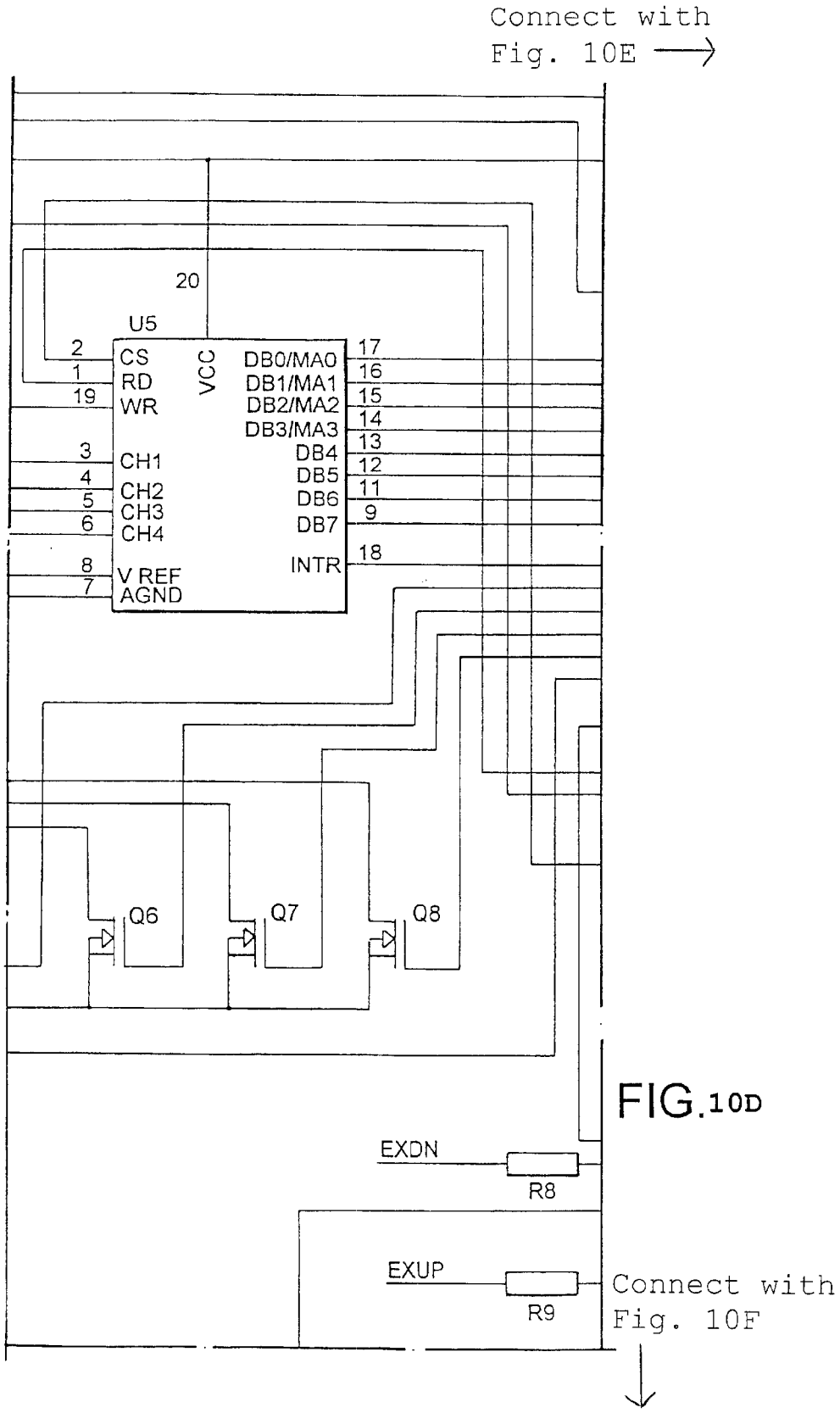
Figure 10E:
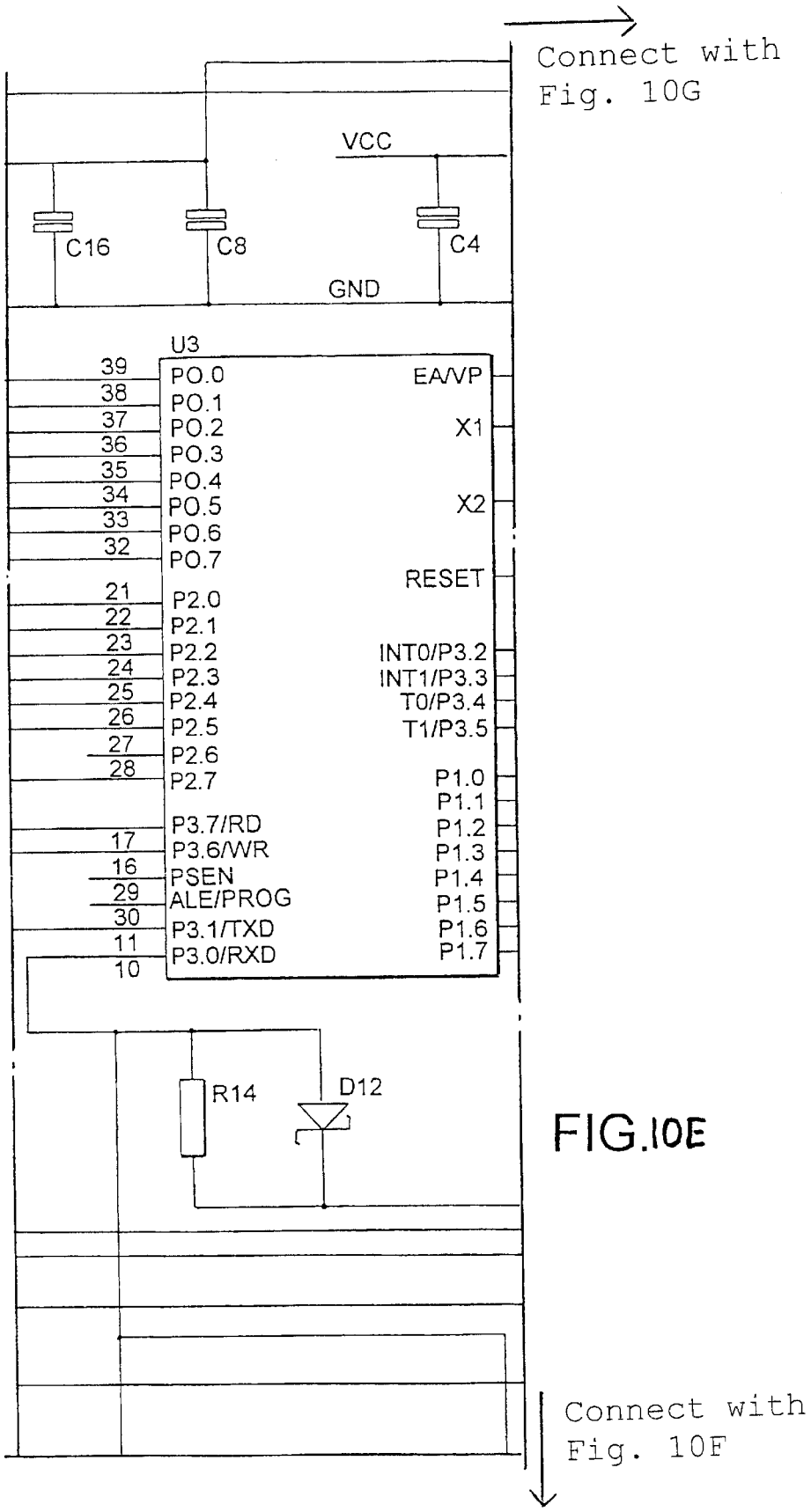
Figure 10F:
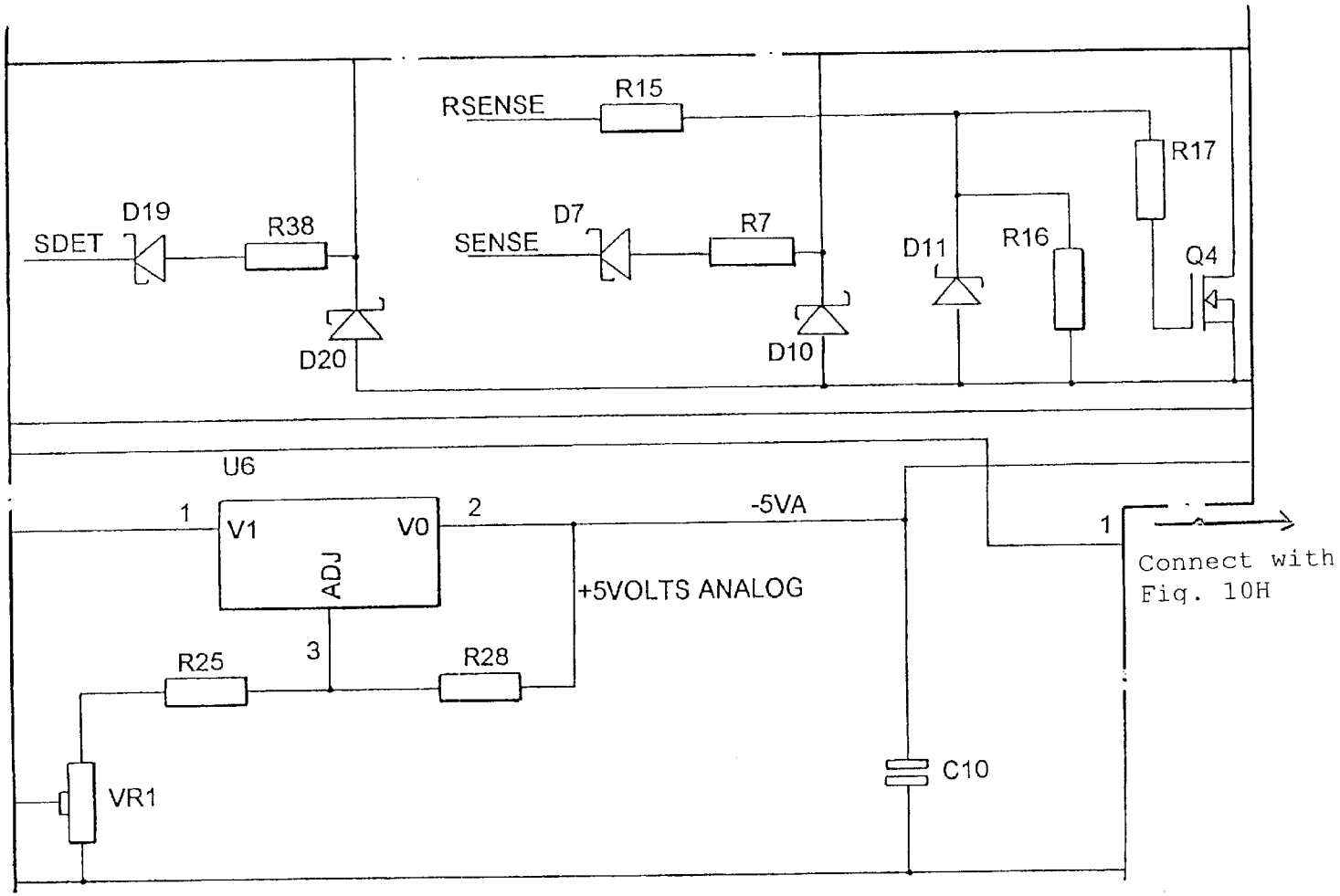
Figure 10G:
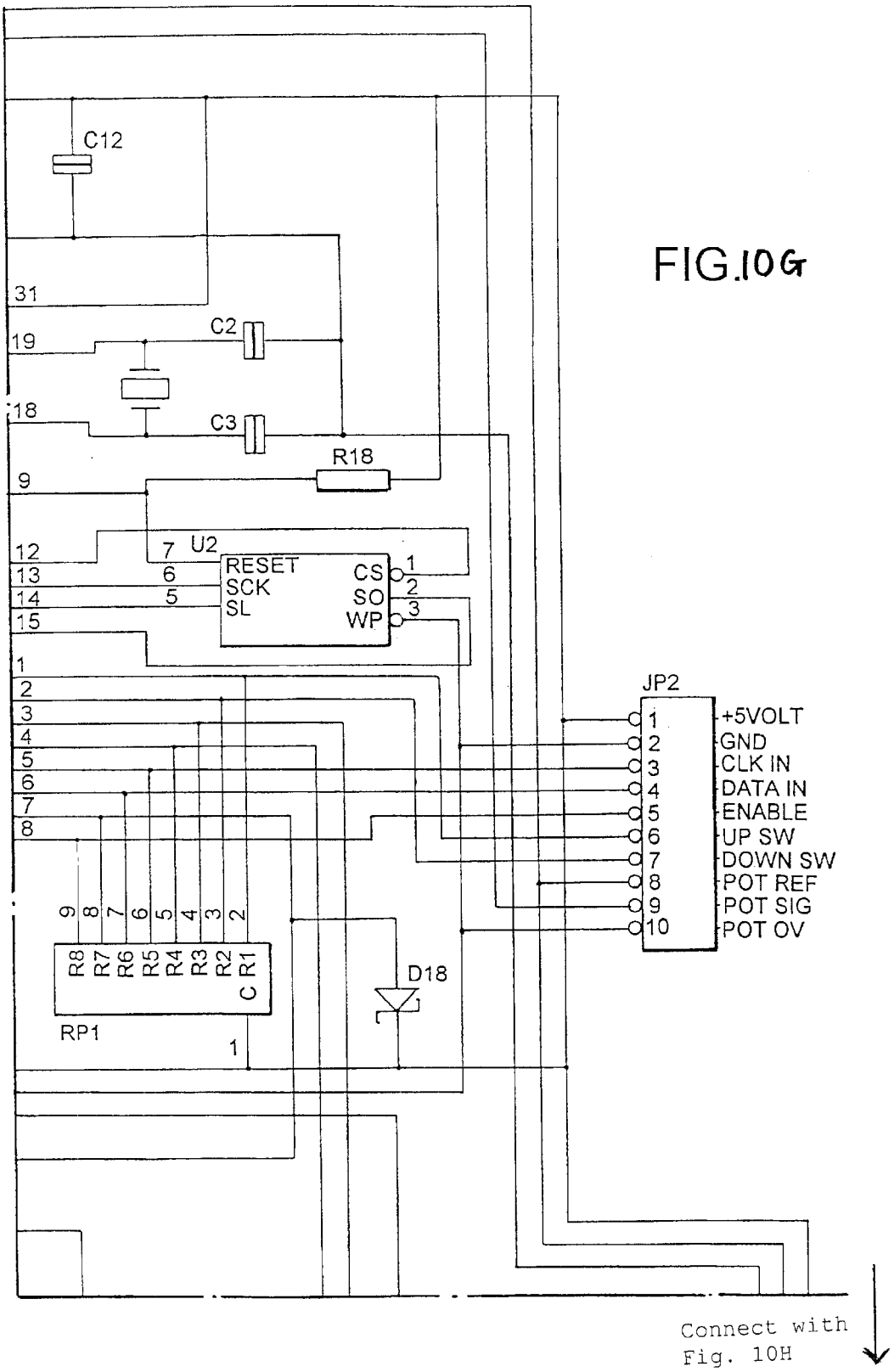
Figure 10H:
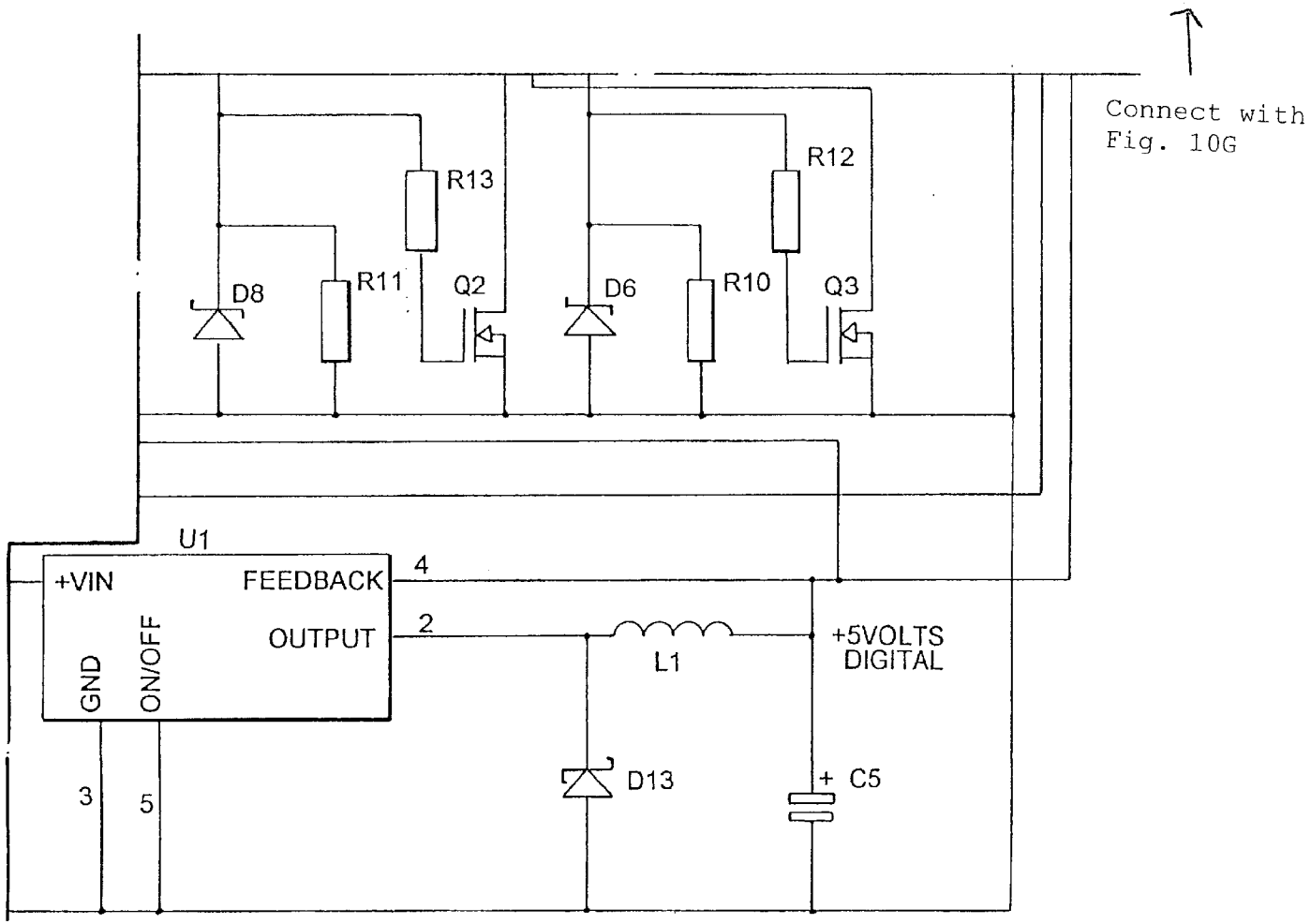

Turning now to FIGS. 7, 8 and 9 there is shown a balance beam 132 mounted by pivot bearing 133 to one end of a pivot support 134, the other end of which is connected to the frame. The beam 132 is also connected to actuator arm 1 and on the other side of the pivot bearing 133 to a counterbalance means in the form of a gas strut 135, 137 (see FIGS. 8 and 9) to counterbalance the weight of the brush head. The opposite end of beam 132 is linked to the brush head by a turnbuckle linkage 36, which is used to adjust the counterbalance for brushes of different length, for example to prevent jamming of the brushes against the floor.

A potentiometer 333 for measuring brush wear is connected between the balance beam 132 and the pivot support 134.

Further support for the brush head is provided by a parallelogram linkage 138 between the brush head and the side of the main frame to keep the brush deck positioned.

A drive wheel 139 for the machine is shown: usually one such wheel is positioned at each corner of the chassis or frame.

The path of movement of the counterweight is shown by arrow A, as the brushes are raised by the lower line and as they are lowered by the upper line. As the brushes are lowered to the floor by the actuator 10 the balance beam 132 rotates about pivot bearing 133 serving to compress the gas strut arrangement 135, 137. The deck 8 is lowered to the floor by the extension of the actuator 1. However as the deck 8 approaches the floor, the pressure to be exerted by the deck 8 on the floor is advantageously counterbalanced by the gas strut means 135, 137. This counterbalancing action is achieved by the compression of the gas strut arrangement 135, 137 which, having a sealed volume within the chamber 135, limits the degree to which the piston member 137 is slidable within the chamber 135 and, advantageously in a resilient manner. Thus, the relative movement between the piston member 137 and the chamber 135 advantageously allows for the exertion of an accurately determinable low pressure at the brush head 8 since the limiting, and thus counterbalancing, effect of the gas strut arrangement 135, 137 serves to effectively reduce the pressure applied by way of the actuator 1, and through the deck 8, to the floor.

When the force exerted by the actuator 1 on the deck 8 is removed, i.e. the actuator 1 is retracted so as to raise the deck 8, the compressed pressure within the chamber 135 is relieved and the gas strut arrangement 135, 137 extends and the volume of fluid introduced into the chamber 135 is chosen such that the extended gas strut arrangement 135, 137 can readily support the deck 8 in such a raised position.

It will be appreciated that, by acting as a counterbalancing force, the gas strut arrangement 135, 137 serves to offer support for the weight of the brush head 8 and allows the net force exerted by way of the actuator 1 through the deck 8 onto the floor to be accurately controlled particularly in the range of zero pressure to pressure corresponding to the weight of the deck 8.

FIG. 8 is a side view of another embodiment of the present invention in which the features common to FIG. 7 are provided with the same reference numerals.

The counterbalance arrangement illustrated in FIG. 8 operates in a similar manner to that illustrated with reference to FIG. 7 in that, as the deck 8 is lowered towards the floor by means of the actuator 1, the gas strut arrangement 135*a*, 137*a* is compressed.

As will be appreciated from FIG. 8, the device includes a shorter parallelogram arrangement 138*a* than found in FIG. 7, and the gas strut arrangement 135*a*, 137*a* is operatively connected between a frame portion of the sweeping/cleaning machine and the deck 8 by means of its connection to the lower strut of the parallelogram arrangement 138*a*. As will be appreciated, as the deck 8 is moved towards contact with the floor surface to be swept or cleaned the parallelogram arrangement 138*a* pivots in a clockwise manner serving to move the piston member 137*a* into the chamber 135*a* of the gas strut arrangement and which relative movement is gradually resisted by the pressure developed within the chamber 135*a*. The counterbalancing force offered by the gas strut arrangement 135*a*, 137*a* shown in FIG. 8 serves to provide a net force at the deck 8 which can readily be controlled particularly in the range zero pressure to a pressure corresponding to the weight of the deck 8.

Turning now to FIG. 9, yet another embodiment of the present invention is illustrated and in which the features common to FIGS. 7 and 8 have been given similar reference numerals.

The main difference between the embodiment of FIG. 9 and the embodiments of FIGS. 7 and 8 is that the required net force exerted by the brushes or pads on the surface is achieved when the gas strut arrangement 135*b*, 137*b* is extended rather than compressed. Again, it is the pressure within the chamber 135*b* that limits the extent to which the piston member 137*b* can be extended therefrom and this serves to counterbalance the force exerted by way of the actuator 1. The gas strut arrangement 135*b*, 137*b* of the embodiment of FIG. 9 is operatively connected between an extension bracket 140 of the frame 130 of the cleaning machine and a connection lug 141 of the deck 8. As will be appreciated from FIG. 9, as the actuator is operated so as to lower the brush head arrangement towards the ground to be swept/cleaned, the gas strut arrangement 135*b*, 137*b* is extended and effectively becomes tensioned in view of the pressure developed within the chamber 135*b*. In reverse when the brush head arrangement is raised from the floor, the pressure developed within the chamber 135*b* by the previous relative movement between the chamber 135*b* and the piston member 137*b* serves to assist with supporting the weight of the brush head arrangement clear of the floor.

As with each of the embodiments described herein, the gas strut arrangement can advantageously be provided in a manner such that the pressure within the chamber thereof can be selectively varied to any particular value when the brush pressure arrangement is at rest, i.e. when the brush head arrangement is raised from the floor.

The circuit of FIGS. 10A–10H can be used as the control system for the system and provides for an advantageous arrangement for achieving accurate control of the pressure and speeds required of the present invention. It comprises standard integrated circuits including a programmed micro controller or micro-processor U3, power supply IC's U1, U4 and U6, non-volatile memory store U2, and analogue to digital converter U5.

A measured pressure signal from a pressure bridge or strain gauge mounted in the cleaning head is input to the microprocessor U3 via instrumentation amplifier U7 and analogue to digital converter (ADC) U5.

The state of external switch inputs on the cleaning machine are sampled via buffer JP2.

The microprocessor U3 makes appropriate calculations based on the sampled values and the set system variables and outputs control signals via mosfets Q5 to Q8, relays RL1, RL2, RL3, and RL4 and buffer JP1 to contact relays to operate the actuator on the cleaning machine itself For example, when relay RL4 is tripped 365 volts are applied to the cleaning head lowering actuator, when relay RL3 is tripped 36 volts are applied to raise the cleaning head, and when relay RL1 is tripped the drive control or traction of the cleaning machine is inhibited. When relay RL2 is activated, the brush/pad motor solenoid is switched on. This is programmed to occur only when the actual brush pressure and the desired brush pressure are balanced and also only when the machine is in motion to prevent the brushes marking the floors whilst stationary.

The SENSE input on buffer JP1 senses whether or not the cleaning machine is moving. If it is, then the circuit inhibits pressure changes to avoid damaging the brushes.

The SPEED input on buffer JP1 senses whether the brushes have been selected for high or low speed. This information is passed to processor U3 which limits the brush pressure at high speed to a pre-determined range to protect the brush motors.

Buffers JP2 supplies signals to the machine control panel to display the actual measured pressure indication and the set value indication respectively on LED displays.

Further modifications can be included in this circuit, for example a battery monitor could advantageously be incorporated to record the total usage time and monitor the charge state of the battery. Under certain predetermined conditions, as programmed into the system parameter memory circuit U2, the cleaning brushes would be automatically raised. Such conditions would typically be long battery usage and/or low battery charge. The operator would then necessarily have to take the machine back to the depot to recharge or replace the battery thus preserving the warranty on the battery.

The control circuit of the invention is very finely tunable and achieves extremely accurate pressure settings for the brush head.

The micro-controller U3 is preferably programmed to always effect pressure changes in a direction such that the brushes are moved downwardly and this aids the accuracy of the settings. For example, if a change in pressure from 100 lbs to 40 lbs is required by an operator, the controller will cause a jump to a value around 20 lbs and then slowly increase the pressure up to the required value of around 40 lbs. This arrangement overcomes stiction in the machine. It is particularly advantageous if phase advance calculations are also used by the micro-controller such that the micro controller calculates the speed at which the pressure changes are occurring and makes appropriate adjustments.

The circuit also preferably monitors the state of the external brush head raise/lower switch and the microprocessor U3 can be programmed to take the state of this switch into account in making decisions on whether to effect certain operations.

Figure 11:
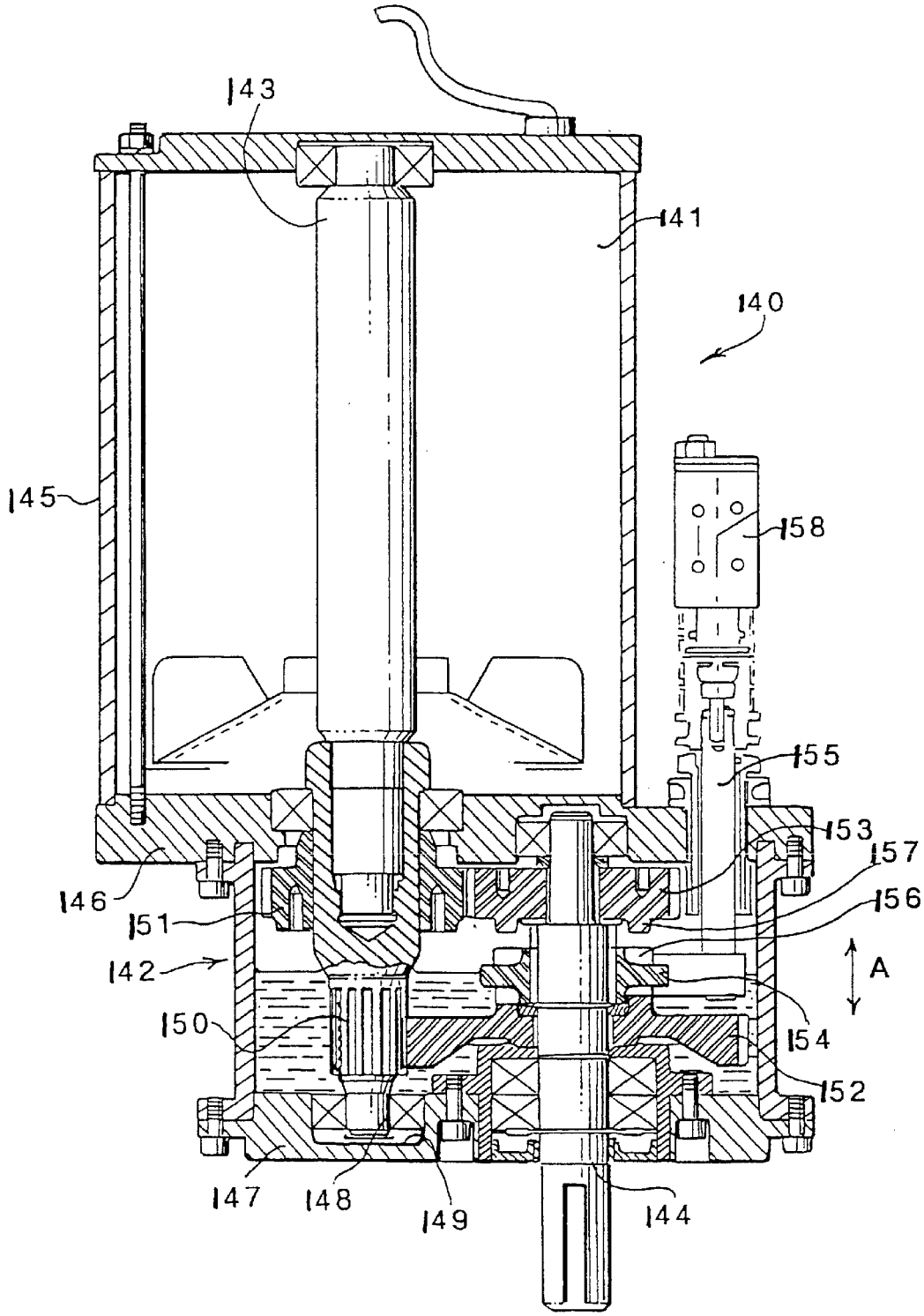
FIG. 11 is a cross-sectional view through a selectively operable gearing arrangement for use in selecting the speed in which the surface working means of the present invention is driven.

FIG. 11 shows a cross-section through a working-head driving arrangement 140 according to one embodiment of the present invention and which comprises a motor 141 in association with a gearbox 142.

A drive shaft 143 within the motor provides for the rotational input gearbox 142, and an output shaft 144 extending from the gearbox 142 provides for a driving output of the arrangement to the rotatable cleaning/burnishing head of the apparatus.

The motor comprises a housing 145 which extends in a direction parallel to the motor shaft 143 and a motor closure plate 146 is provided at the end of the motor housing 145 adjacent the gearbox 142. Indeed, the gearbox is mounted by way of bolt means to the motor closure plate 146 and so that the output shaft 144 of the gearbox 142 extends parallel to the longitudinal axis of the motor shaft 143.

The gearbox 142 includes a housing which extends from the motor closure plate 146 and which is closed, at its end remote from the motor closure 146, by a gearbox closure plate 147 through which the output shaft 144 extends.

The input shaft 143 engages with a stub shaft 148 which extends into the gearbox 142 and which is rotatably secured, at its end remote from its engagement with the input shaft 143, in a locating recess 149 provided in the inner surface of the gearbox closure plate 147. The locating recess 149 provides for rotatable mounting of the stub shaft 148 within the gearbox.

The stub shaft 148 is provided with two gears along its axial length. A first gear 150 is provided at the end of the stub shaft 148 adjacent to the recess 149 and this first gear 150 has a diameter slightly less than the stub shaft 148. A second gear 151 located on the stub shaft 148 and adjacent to the motor closure plate 146 has a diameter greater than the stub shaft 148.

As will be explained later, the first 150 and second 151 gears provided on the stub shaft 148 are arranged to provide predetermined gear ratio within the gear arrangement of the gearbox 142.

The output shaft 144 is rotatably mounted within the gearbox and, as will be appreciated, extends between respective bearing sets located adjacent to the motor closure plate 146 and the gearbox closure plate 147.

As with the stub shaft 148, the output shaft 144 includes two gears spaced along the axial direction of the output shaft 144 such that one of the gears 152 is arranged to mesh with the first gear 150 on the stub shaft 148 and the other of the gears 153 is arranged to mesh with the second gear 151 provided on the stub shaft 148.

The gear 153 provided on the output shaft 144 is arranged to have a diameter which is the same as that of the second gear 151 on the stub shaft 148 such that the gear ratio between the gears 151 and 153 1:1.

The gear 152 provided on the upward shaft 144 has a larger diameter than the gear 150 provided on the stub shaft 148, and indeed the gears 151, 153.

The gear 152 is chosen such that the gear ratio between the gears 150 and 151 is 5:1.

The aforementioned gear ratios provide for the speed reduction required when switching between a floor scrubbing and floor burnishing operation and so the gearbox of FIG. 11 provides for an effective two-speed gearbox. As will be appreciated, when the gear pair 151, 153 provide for rotation of the output shaft 144, the output shaft rotates at a speed consistent with the speed of the motor, for example 1,000 rpm. However, when the gearbox is switched so that the gear pair 150, 152 drive the output shaft 144, the gear ratio 5:1 of this gear pair determines that the speed of the output shaft, and thus the drive to the surface-working head member, is reduced to 200 rpm.

The aforementioned respective speeds are those preferred for scrubbing and burnishing operations and so, along with an appropriate control of the pressure at which the surface-working head member is applied to the surface, scrubbing and burnishing operations can be provided by the apparatus.

As will further be appreciated from FIG. 11 the gear pairs 151, 153 and 150, 152 are mounted in constant mesh and the gears 152, 153 on the output shaft are arranged to be free running during operation of the motor and to selectively control the drive of the output shaft 144 by means of a dog-clutch 154.

The dog-clutch 154 is driven by means of an actuator 155 in a reciprocal manner in the direction of arrows A so as to either engage with a face of the gear 152 or a face of the gear 153. The dog-clutch 154 is provided with opposite facing surfaces including gearing recesses 156 which are arranged to receive gear stubs 157 formed on the aforementioned faces of the gears 152, 153.

In its position as illustrated in FIG. 8, the dog-clutch 154 is moving into engagement with the gear stubs of the gear 152 so as to provide for a rotational drive to the surface-working head member at a speed of 200 rpm.

The actuator 155 is driven by way of a gear-change actuator assembly which can advantageously be solenoid driven and which can further include solenoid locking means so as to advantageously prevent movement of the dog-clutch once a particular speed rotation of the output shaft 144 has been selected.

As mentioned previously, the gear-change actuator assembly 158 can be advantageously associated with control means whereby the selection of a particular pressure to be applied by way of the surface-working head arrangement serves to actuate the gear-change assembly 158 to select the particular gear ratio, or alternatively, a selection of a particular gear ratio serves to effect, or limit, the pressure applied by way of the selective pressure exertion means in response to the gear ratio selected.

FIGS. 12–17 illustrate the features of one particular embodiment of another aspect of the present invention and which relates to the actual surface working device to be releasably mounted upon a drive member depending downwardly from a surface working machine such as that described hereinbefore.

Indeed, the aspect of the invention illustrated by way of the embodiment of FIGS. 12–17 relates to one particularly advantageous version of the drive plate mounting arrangement illustrated for example in FIG. 4 of the present application.

As shown in FIG. 12 the surface working device for releasible attachment 200 includes a substantially cylindrical upstanding central portion 204 integral with an outwardly extending annular support plate 202 (only shown in FIG. 13).

The central portion 204 is provided with a blind bore 206 having a hexagonal lateral cross section as clearly shown in FIG. 12 and which has a lower surface 208 formed with a concave profile.

The attachment 200 has a lower surface 210 to which a surface working element such as a pad or brush can be releasibly or fixedly secured.

As is clear from FIG. 13, the concave lower surface 208 of the blind bore 206 formed in the upstanding central portion 204 of the attachment is itself provided with a cylindrical blind bore 212 which, as is clear from FIGS. 12 and 13, is coaxial with both the main blind bore 206 and the upstanding cylindrical central region 204.

The smaller blind bore 212 formed in the concave surface 208 comprises an engagement formation as will be described later for receiving a resilient member allowing for resilient movement between the attachment 200 and a drive member received in the recess 206 thereof Turning now to FIG. 14, there is illustrated a plan view of the central region of the surface working attachment which has been assembled ready for releasible attachment on to a drive member of a surface working machine.

Figure 14:
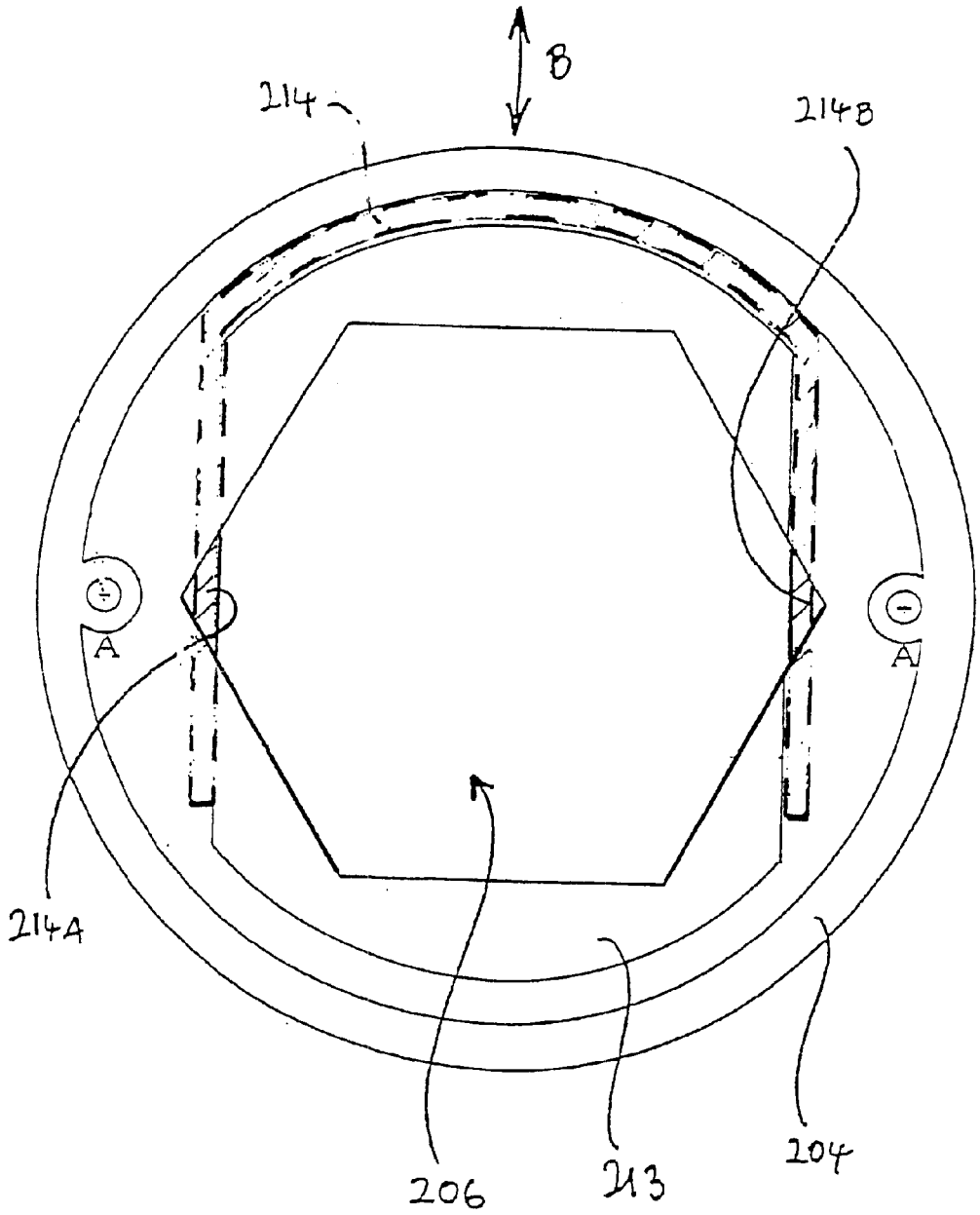
FIG. 14 is a plan view of the central region of FIG. 12 but illustrating further mounting and retention features of this embodiment of one aspect of the invention.

The main difference between arrangement as shown in FIGS. 12 and 14 is that in FIG. 14 an upper retaining plate 213 having a hexagonal central opening has been secured to the upper face of the central region 200 by screws A and a spring retaining clip 214 has been sandwiched therebetween for lateral movement in the direction of arrows B in FIG. 14.

As can be appreciated from FIG. 14, the retaining spring clip 214 is similar in form to the spring clip 38 illustrated in FIG. 6A and has leg portions which include regions 214A, 214B which extend into opposite regions of the hexagonal blind bore 206.

The portions 214A, 214B of the spring retaining clip 214 can however be deformed radially outwardly of the upstanding central portion 204 in a resilient manner so as to allow for entry of a drive member having a drive head with a hexagonal cross section similar in dimensions to the hexagonal cross section of the blind bore 206. Once the hexagonal drive head of the drive member has passed into the blind bore however, the portions 214A, 214B of the spring clip 214 return to the position shown in FIG. 14 so as to prevent movement of the hexagonal drive head of the drive member until required. When such removal is required, the regions 214A, 214B of the spring retaining clip 214 can be deformed radially outwardly of the upstanding portion 204 so as to allow for removal of the hexagonal head of the drive member.

One such drive member 216 is illustrated by way of FIGS. 15 and 16 and comprises a central cylindrical shaft 218 having a hexagonal drive head 220 formed at the lower end thereof.

The undersurface of the drive head 222 is provided with a gently convex profile. Such a gently convex surface 222 can advantageously cooperate with the gently concave surface 208 of the blind bore 206 as shown in FIG. 13 so as to allow for a slight gimballing effect between the drive shaft 216 and the attachment 200.

Figure 17:
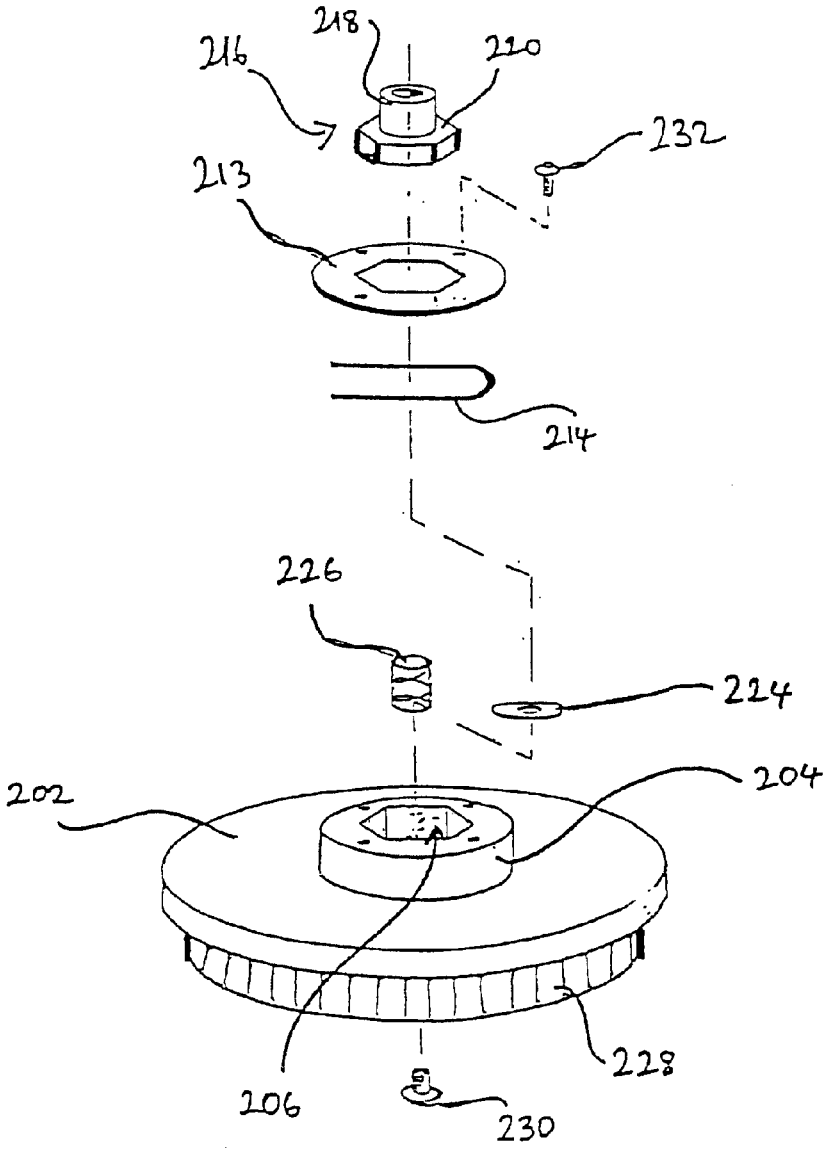
FIG. 17 is an exploded respective view of the complete surface working device embodying one aspect of the present invention.

Turning finally to FIG. 17, there is shown an exploded perspective view of various features of FIGS. 12–16 when arranged for assembly.

As can be appreciated, the mounting plate 213 is arranged to be secured by screws 232 to the upper surface of the upstanding central cylindrical portion 204 so as to sandwich the spring retaining clip 214 therebetween.

The recess 206 is then ready to receive the head 220 of the driving member 216 and which is retained therein by means of the spring retaining clip 214.

However, prior to insertion of the driver member 216 into the blind bore 206, a compression spring 226 is located coaxially within the blind bore 206 and so as to have its lower region received in the smaller blind bore 212 illustrated in FIG. 13.

An engagement plate 224 is located above the spring 226 once received in the smaller blind bore 212 and the plate 224 is itself then arranged to be sandwiched between the upper region of the spring 226 and the undersurface of the hexagonal head of the driving member 216.

The depth of the smaller blind bore 212 is advantageously chosen so as to determine the maximum compression that the spring 226 will have to suffer and is a particularly advantageous example of a spring-engagement formation to be provided within the blind bore of the central region of the support plate for the surface working element.

FIG. 17 further illustrates the nature of such a surface working element such as a brush 228 which is arranged to depend downwardly from the support plate 202 and which can be secured to the small plate by means of mounting screws 230.

The further aspect of the invention as illustrated in FIGS. 12–17 is not restricted to the particular details shown since it should be appreciated that any appropriate recess can be provided for receiving the driving member and which itself can be provided with any appropriate formation for receiving part of a resilient member which of course may be in any appropriate form.

For example, in FIG. 17 the mounting plate 213 can be arranged for rotation between positions allowing for the securing or release of the driving member 216. Also, while the dimensions of the illustrated elements can be determined as required, the height of the upstanding central portion 204 is preferably greater than ½ inch (1.27 cm).

However, it will be appreciated that, in common with the embodiment of FIGS. 12–17, the further aspect of the present invention is advantageous in providing for a readily reasonably securable surface working device that can nevertheless exhibit appropriate resilient mounting so as to independently follow any undulations in the surface being worked independently of the movement of any other surface working devices that might be attached to one of the same surface working machine.

It should be appreciated that the surface working head arrangement of the present invention can be embodied in any appropriate surface working apparatus other than the combined burnishing/scrubbing apparatus illustrated herein.

What is claimed is:

1. Surface working apparatus with a surface working head arrangement comprising:

a frame member;

a plurality of surface working members arranged to depend from said frame member in a direction of the surface to be worked, each of said plurality of surface working members being mounted resiliently relative to said frame member by one of a plurality of respective resilient mounting arrangements having a resilient member;

an actuator arranged to act downwardly on the frame member, said actuator comprising a spring suspension means for biasing the frame member, the spring suspension means commonly biasing the plurality of surface working members towards the surface to be worked through the biasing of the frame member, a tensioning means for tensioning the spring suspension means so as to commonly set a pressure of the plurality of surface working members, the spring means being selectively adjustable by the tensioning means over a continuous range to provide a required common bias towards the surface through the frame member;

drive means mounted to said frame member with said surface working members being resiliently mounted to said drive means;

each of said drive means comprising a drive shaft, said resilient member being located between said drive shaft of one of said drive means and a surface working member drive adaptor means such that each said resilient member is operatively coupled in series with said spring suspension means so that the force to be exerted on the surface by operation of the actuator can be delivered via both the spring suspension means and each of said resilient members providing self-leveling of the corresponding working member;

said surface working means comprising a drive motor shaft adaptor, said drive motor shaft adaptor being drivingly located between said drive shaft and said resilient member, said surface working drive adaptor comprising a hollow cylindrical housing recess portion for receiving one end of said drive motor shaft adaptor, wherein said resilient member is located within a cylindrical housing recess portion for contact between a lower surface thereof and an undersurface of said drive motor shaft adaptor, said cylindrical housing recess portion within which the resilient member is located comprising a further recess formed coaxially with said cylindrical housing recess portion, and the further recess serving to determine the maximum deformation of the resilient member.

2. Apparatus as claimed in claim 1, wherein each resilient mounting arrangement includes a compression spring.

3. Apparatus as claimed in claim 2, wherein the compression spring is arranged to be compressed to substantially half its length when a surface working head of said surface working head arrangement is arranged to exhibit a force relevant to the surface to be worked.

4. Apparatus as claimed in claim 1, wherein a resilient mounting arrangement is arranged to be selectively operative dependent upon the pressure to be exerted through the surface working head arrangement to the surface to be worked.

5. Apparatus as claimed in claim 4, wherein the selective operation is achieved through movement of the resilient member within the mounting arrangement and into, and out of, a position in which it can be influenced by increases and decreases in the pressure to be applied by way of the surface working head arrangement.

6. Apparatus as claimed in claim 5, and arranged such that the resilient member moves out of an operative position in which it can be deformed once the pressure applied through the surface working head arrangement exceeds a threshold level.

7. Apparatus as claimed in claim 6, wherein the resilient mounting arrangement includes a housing provided with an engagement formation arranged to be engaged so as to prevent further biasing of the resilient member as the surface working head arrangement serves to increase the pressure to be applied to the surface being worked.

8. Apparatus as claimed in claim 7, wherein the engagement formation comprises a shoulder portion arranged adjacent the resilient member.

9. Apparatus as claimed in claim 8, wherein the engagement formation comprises an annular shoulder member disposed around a bore for receiving the resilient member.

10. Apparatus as claimed in claim 9, wherein the resilient member is operatively associated with a contact plate for contacting the undersurface of the drive motor shaft adaptor.

11. Apparatus as claimed in claim 10, wherein the undersurface of the drive motor shaft arranged to contact the resilient member by way of the contact plate is provided with a chamferred, partially convex, or part spherical surface which serves to assist with a gimbal-like movement of the housing member relative to the drive motor shaft adapter.

12. Apparatus as claimed in claim 1, and including a resilient clip means serving to retain the drive motor shaft adapter within the housing.

13. Apparatus as claimed in claim 12, wherein the drive motor shaft adapter has an engagement formation arranged to receive the clip means and the transverse cross-section of the drive motor shaft adaptor exhibits corner regions at which the engagement formations are located.

14. Apparatus as claimed in claim 13, wherein at least one aperture is formed in a side wall of the cylindrical housing recess/portion and serves to guide the clip means in the region of the shoulder portion of the drive motor shaft adapter.

15. Apparatus as claimed in claim 14, and arranged such that outer surfaces of the side walls defining the cylindrical housing recess portion serve as ramp means for at least a portion of the clip means so that as the said portion of the clip means is moved along the ramp means, the clip means is deformed outwardly relative the centre of the drive motor shaft adaptor so as to allow for its removal from the cylindrical housing recess portion.

16. Apparatus as claimed in claim 1, and adapted for the releasable mounting of a variety of surface working elements each having different surface working characteristics.

17. Apparatus as claimed in claim 16, and including means for selectively varying the pressure exerted by the surface working head and arranged to alter said pressure in response to the working characteristics of the surface working head arrangement.

18. Apparatus as claimed in claim 16, and including means for selectively varying the speed at which said head arrangement is driven by said motor in response to the working characteristics.

19. Apparatus as claimed in claim 18, wherein the means for selectively varying the speed at which the head arrangement is driven comprises a selective plurality of gear arrangements having gear ratios determined on the basis of the working operations required.

20. Apparatus as claimed in claim 19, wherein the gearing arrangement comprises respective pairs of gears in constant mesh and means for selecting one of said pairs for delivering a drive from a gearbox comprising said selectively plurality of gear arrangements.

21. Apparatus as claimed in claim 20, wherein the means for selecting the said one of said pairs comprises dog-clutch means.

22. Apparatus as claimed in claim 21, and including means for controlling switching in the gearbox and which is associated with means for selecting the pressure applied by way of the surface working head arrangement and arranged such that the switching of the gearbox is achieved in response to the selection of particular pressure values either above or below one or more threshold values or the selection of specific values.

23. Apparatus as claimed in claims 1, and including an actuator arrangement for raising and lowering the surface working head arrangement and mounted between the frame and the surface working head arrangement, and means operatively connected to the surface working head arrangement and arranged to at least partially counteract the force to be exerted via the surface working head arrangement on the surface, and so as to control the pressure exerted by the surface working head arrangement on the surface to a range which includes zero pressure to a pressure corresponding to the weight of the surface working head arrangement.

24. A surface working device comprising:

a support plate with a horizontal lower surface; and a surface working element with a horizontal upper surface, the upper horizontal surface of the surface working element being mounted to the horizontal lower surface of the support plate to depend from and be located below the horizontal lower surface of the support plate, said support plate including an upper surface, which upper surface has a central region with a recess provided therein for the receipt of, and engagement by, a drive member for rotating the device, wherein the recess includes a formation for receiving a resilient member intended for engagement by the drive member, wherein said formation for receiving the resilient member comprises a further recess formed coaxially with said recess provided at the central region of the support plate, and the further recess serves to determine the maximum deformation of the resilient member.

25. A device as claimed in claim 24, wherein the said central region comprises an upstanding region for at least part defining the recess and wherein the depth of the recess is independent of the thickness of the support plate.

26. A device as claimed in claim 24, wherein the resilient member comprises a compression spring and is arranged to extend coaxially with the said further recess.

27. A device as claimed in claim 24, wherein the recess provided in the central region of the support plate has a substantially hexagonal transverse cross-section and is arranged for receiving a substantially hexagonal head of the drive member.

28. A device as claimed in claim 27, wherein the depth of the recess formed in the said central region is at least slightly greater than the height of the hexagonal head of the drive member.

29. A device as claimed in claim 28, wherein the said central region of the support plate is arranged to operatively receive a spring retaining clip means which requires deformation to allow the drive head into, or out of, the recess formed within said central region.

30. A device as claimed in claim 24, wherein the resilient member is associated with a abutment member for contacting the drive member.

* * * * *